US006122952A

United States Patent [19]

Ashwill et al.

[11] Patent Number: 6,122,952

[45] Date of Patent: Sep. 26, 2000

[54] MULTIPLE ACTUATION PRESS FOR METAL WORKING AND METHOD OF METAL FORMING

[75] Inventors: Larry D. Ashwill; Nathan R. Hanson; Joseph J. Rupp; Roger W. Schmitz, all of Hutchinson, Minn.

[73] Assignee: Hutchinson Technology Incorporated, Hutchinson, Minn.

[21] Appl. No.: 09/057,873

[22] Filed: Apr. 9, 1998

[51] Int. Cl.[7] ..... B21D 22/06; B21J 5/12

[52] U.S. Cl. ..... 72/407; 72/404; 72/453.01; 72/453.08

[58] Field of Search ..... 72/404, 456, 453.01, 72/453.02, 453.18, 453.14, 335, 334, 327, 407, 453.08

[56] References Cited

U.S. PATENT DOCUMENTS

| | | | |
|---|---|---|---|
| 324,507 | 8/1885 | Walton | 72/404 |
| 2,223,281 | 11/1940 | Dinzl | 72/404 |
| 3,200,423 | 8/1965 | Byam | 72/404 |
| 3,861,192 | 1/1975 | Suzuki | 72/456 |
| 4,442,691 | 4/1984 | Grow | 72/456 |
| 4,918,970 | 4/1990 | Ishinaga | 72/407 |

FOREIGN PATENT DOCUMENTS

| | | | |
|---|---|---|---|
| 467285 | 11/1974 | Australia | 72/456 |
| 1071520 | 12/1959 | Germany | 72/335 |
| 1812860 | 6/1970 | Germany | 72/404 |
| 2806148 | 8/1979 | Germany | 72/456 |
| 647286 | 10/1962 | Italy | 72/453.01 |

OTHER PUBLICATIONS

Sales Brochure: Agathon Solothurn–Switzerland; Guide Elements; 2 pages.

Sales Brochure: Schneeberger Linear Technology, Edition 594 e/01; 2 pages.

Sales Brochure: Enomoto Guidemax; Enomoto Co., Ltd.; 2 pages; Dec. 13, 1996.

Sales Catalogue: U.S. Baird, The U.S. Baird Corporation; Catalogue No. 8; 1992.

Sales Catalogue: Schmidt Feintechnik Corporation, Advantage of Automation; Form–Nr. 181/09/94/3000/1 U.

Sales Catalogue: Gechter, Your specialist in presses; Gechter GmbH; 34 pages.; Sep. 1995.

*Primary Examiner*—Daniel C. Crane
*Attorney, Agent, or Firm*—Faegre & Benson

[57] ABSTRACT

A forming press that can perform multiple actuations within a single forming press, and which can be done accurately and with reduced overall machine size requirements. A first component side of the forming press can comprise multiple forming components, each of which may be separately actuated with respect to the other. Likewise, a second component side of the forming press also comprises multiple forming components that are independently actuable. The actuators of the press, as well as the multiple forming components, may lie on the same center line of the first and second component sides. By this construction, side loading is practically eliminated so as to produce consistent high quality formed parts and to enhance tool life. Preferably, guide surfaces for at least some of the rams of the forming press include at least a non-circular portion, and more preferably, plural non-circular portions that are flat portions so that needle bearings can be supported between the flat portions of the guides and corresponding flat portions of the rams. A method of forming a part, such as a head suspension, by a forming press having a first component side and a second component side, wherein multiple forming operations are actuated from at least one of the first and second component sides.

20 Claims, 23 Drawing Sheets

MULTIPLE ACTUATION PRESS FOR METAL WORKING AND METHOD OF METAL FORMING

TECHNICAL FIELD

Present invention relates to metal working equipment and methods for forming metal utilizing forming elements, such as a punches and dies, that are actuable toward one another, for consistently and accurately performing metal forming operations. More specifically, the present invention relates to a forming press having the capability to perform multiple forming operations caused by independent actuation of forming elements within the single forming press, and without the need to move the formed product to a different forming station.

BACKGROUND OF THE INVENTION

The present invention has been developed as a metal forming operation with particular applicability to the making of head suspensions for the disk drive industry. Head suspensions, to which the present invention is directed, comprise components made of spring metal for supporting magnetic read/write heads within certain disk drive assemblies. These head suspensions are typically very small in size and comprise many features related to its ability to very accurately but compliantly position a read/write head over a data track of a disk within the disk drive assembly. With the trend to increase density of such disks and to utilize even smaller disk drives, head suspensions must also be made smaller, but must also still include many tiny features to ensure accurate operation. Head suspensions are typically made from stainless steel sheet material having thicknesses ranging of between 0.05 mm and 0.10 mm.

Metal forming, as required in the field of making head suspensions, typically includes operations such as stamping, bending, cutting, or otherwise shaping sheet stainless steel material. Usually, such metal forming operations are performed on blanks of the material that have been previously cut or shaped from a sheet of the material, such as by a chemical etching process. Preferably, the blanks are made attached to a carrier strip so that any number of forming operations can be conducted by moving the carrier strip with its attached blanks throughout the requisite number of forming stations.

More specifically, a station performs a forming operation on every blank (unless, possibly, if it is rejected) that is moved through that station in sequence. Then, a next forming operation, and further for as many as are required, are performed by additional machines. The need for additional machines to perform each step of the manufacturing process, including a variety of metal forming steps, requires significant floor space within such a manufacturing facility. Moreover, in order to minimize rejected parts and to maximize feature accuracy, metal forming equipment typically includes significant structure for alignment of the forming components.

Forming practice typically includes a four-post die set utilizing roller ball bearings having cages to guide and align the top and bottom die sets. One of the die sets is normally actuated by pneumatic, hydraulic or mechanical means while the other die set remains stationary within the machine. This type of construction requires the provision of pressure pads, various springs and complex tooling to achieve the needed motion and clamping within the die set. With the use of machines of this type, many tolerances are included within the tool guiding and actuation systems that build on top of one another and can negatively affect the accuracy of die alignment and thus the forming operation. This stack-up of tolerances may render this type of machine unacceptable where very precise forming operations are required.

One development for increasing accuracy and speed in a metal forming operation is disclosed in a U.S. Pat. No. 4,866,976 to Hinterlechner. In the Hinterlechner apparatus, accuracy is achieved by reducing stack-up tolerances in guiding a punch and die set. Specifically, a reference plane is very accurately defined so that a punch and die are accurately guided over the reference plane with respect to one another on at least that one level. Moreover, a roller bearing guide structure is defined wherein the bearings are preloaded to further enhance the accuracy of movement of each of the punch and die. The punch and die are simultaneously moved toward one another by a mechanical drive mechanism. In addition to minimizing stack-up tolerances which can lead to a larger chance of punch and die misalignment, the use of roller or needle bearings is advantageous in that they can handle many times higher loading rates and stiffness as compared to ball bearing cages. Such ball cages have a much greater tendency to deform when placed under heavy loads as compared to roller bearing cages because of the point contact that the balls make instead of the line contact of roller bearings.

SUMMARY OF THE PRESENT INVENTION

The present invention overcomes the disadvantages and shortcomings of the prior art by providing a forming press that can perform multiple actuations within a single forming press, and which can be done accurately and with reduced overall machine size requirements. That is, not only can the need for multiple machines be reduced by a single forming press, the size of the forming press itself can be reduced without compromising accuracy since a single alignment structure assures the accurate alignment of the components of all of the multiple forming operations.

In accordance with the present invention, a first component side of the forming press can comprise multiple forming components, each of which may be separately actuated with respect to the other. Likewise, a second component side of the forming press also comprises multiple forming components that are independently actuable. The actuators of the press in accordance with the present invention, as well as the multiple forming components, may lie on the same center line of the first and second component sides. By this construction, side loading is practically eliminated so as to produce consistent high quality formed parts and to enhance tool life.

The above noted advantages, as well as others, of the present invention, are achieved by a multiple actuation forming press having a first component side and a second component side, between which a forming area is defined, a first primary ram guide connected to a support structure on a first component side thereof, a second primary ram guide connected to the support structure at a predetermined alignment thereof with respect to the first primary ram guide and on a second component side of the support structure, a first outer ram slidably guided by an opening defined at least in part by the first primary ram guide, a second outer ram slidably guided by an opening defined at least in part by the second primary ram guide, a first actuator for moving the first outer ram between extended and retracted positions, and a second actuator for moving the second outer ram between extended and retracted positions, wherein the first outer ram is provided with a guide surface that extends in the same direction of slidable movement of the first outer ram, and which slidably guides a first inner ram that is connected with a first inner ram actuator for moving the first inner ram between extended and retracted positions based upon the alignment of the first and second primary ram guides. The second outer ram is also provided with a guide surface that extends in the same direction of slidable movement of the second outer ram, and which slidably guides a second inner ram that is connected with a second inner ram actuator for moving the second inner ram between extended and retracted positions based upon the alignment of the first and second primary ram guides.

In another case, the first outer ram is further provided with a plurality of guides surfaces that extend in the same direction of slidable movement of the first outer ram, so as to slidably guide a third inner ram that is connected with a third inner ram actuator for moving the third inner ram between extended and retracted positions based upon the alignment of the first and second primary ram guides. Furthermore, the first inner ram can be provided with a guide surface that extends in the same direction of slidable movement of the first outer ram and the first inner ram, and which slidably guides a first more inner ram that is connected with a first more inner ram actuator for moving the first more inner ram between extended and retracted positions based upon the alignment of the first and second primary ram guides. Any additional number of inner rams within one or more other inner rams is contemplated on one or both component sides. Preferably, the guide surfaces of the first and second outer rams and of the first inner ram comprise throughbores, and the first and second primary ram guides include openings defined therethrough for slidably guiding the first and second outer rams, respectively, wherein the openings each include at least a non-circular portion as viewed in transverse cross-section. More preferably, plural non-circular portions are provided that are flat portions so that needle bearings can be supported between the flat portions and corresponding flat portions provided on outer surfaces of the first and second outer rams.

In accordance with another aspect of the present invention, a method of forming a part, such as a head suspension, by a forming press comprises providing a forming press having a first component side and a second component side, the first component side having a first primary ram guide and the second component side having a second primary ram guide, the first and second primary ram guides being aligned with one another at predetermined positions to define a forming area therebetween; providing a part to be formed in the forming area of the forming press; actuating first and second outer rams while slidably guiding the first and second outer rams by the first and second primary ram guides, respectively, so as to advance the first and second outer rams independently toward the forming area; actuating a first inner ram while slidably guiding the first inner ram by a guide surface of the first outer ram, so as to advance the first inner ram independently toward the forming area; and providing a forming component on at least one of the first and second outer rams and the first inner ram so that the part is formed during one of the advancing operations.

DETAILED DESCRIPTION OF THE PREFERRED EMBODIMENTS

Figure 1:
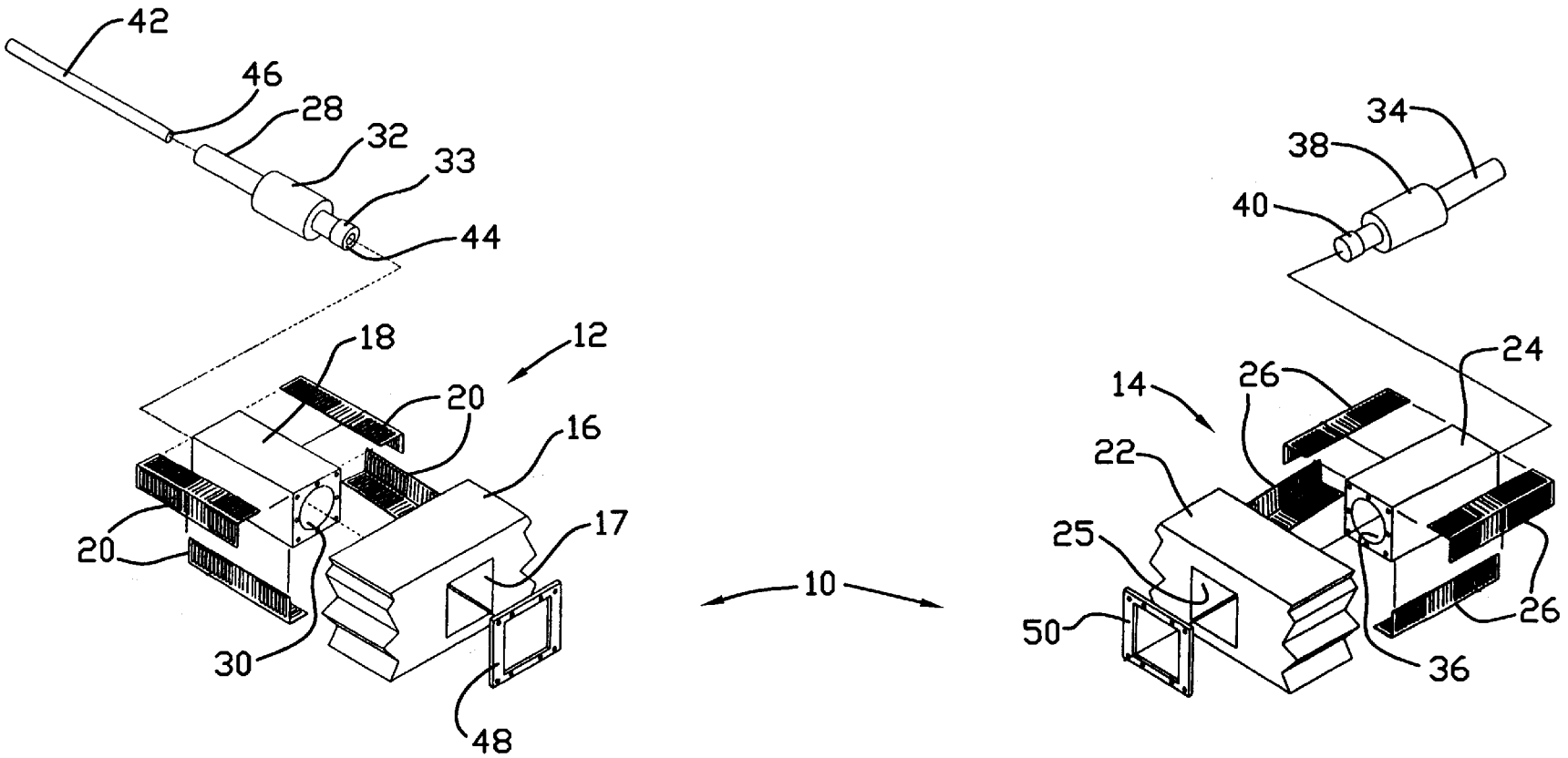
FIG. 1 is a schematic illustration of the first and second component sides of a multiple actuation press in accordance with the present invention.

With reference to the Figures, wherein like numerals represent like components throughout the several Figures, and initially to FIG. 1, a multiple actuation forming press 10 is schematically illustrated comprising a first component side 12 and a second component side 14. As more fully described below, the first component side 12 can be utilized by providing a first forming component, such as a male or punch side of a press, while the second component side 14 can be utilized by providing a female or die component Accordingly, the first component side 12 will be axially aligned with the second component side 14 so as to perform a press forming operation.

The first component side 12 comprises a primary ram guide 16 having a longitudinally extending non-circular opening 17 within which an outer ram 18 is movable in a longitudinal direction of the primary ram guide 16. To facilitate movement of the outer ram 18 within the non-circular opening 17 of the primary ram guide 16, needle bearing cages 20 are preferably provided. The needle bearing cages 20 are preferably provided at the corners of the outer ram 18, which itself is illustrated as square in transverse cross-section. Non-circular opening 17 is preferably similar to the transverse cross-sectional shape of the outer ram 18, but is larger to the extent necessary to accommodate the size of the outer ram 18 plus the size of the needle bearing cages 20 provided therebetween. Needle bearing cages 20 that are commercially available from Schneeberger Inc., USA of Bedford, Mass. can be used. Moreover, the needle bearing cages 20 are preferably subject to a preload when positioned between the outer surface of the outer ram 18 and the inner surface of the primary ran guide 16 defining the non-circular openings 17. That is, when in place, the many needle bearings that are supported within each of the needle bearing cages 20 are subject to a load caused by the insertion of the outer ram 18 therein. This preload is preferable in that it enhances the accuracy of movement of the outer ram 18 along its longitudinal axis within the primary ram guide 16. Thus, in accordance with this construction, as the outer ram 18 is moved longitudinally, the needle bearings of the needle bearing cages 20 will roll over the outer surfaces of the outer ram 18 and likewise roll over the inner surfaces of the primary ram guide 16 defining the non-circular opening 17. The roller bearing cages 20 float between the outer ram 18 and the primary ram guide 16 so that the needle bearing cages 20 move at half the speed of the outer ram 18 longitudinally with the primary ram guide 16 held stationary.

Likewise, the second component side 14 comprises a primary ram guide 22 having a longitudinally extending non-circular opening 25 within which an outer ram 24 is longitudinally movable. Like the needle bearing cages 20 discussed above, needle bearing cages 26 are provided to ride over the outer surface of the outer ram 24 and the inner surface of the primary ram guide 22 defining its non-circular opening 25. The needle bearings of the needle bearing cages 26 are preferably preloaded as discussed above, so as to enhance the precision of movement of the outer ram 24 within the primary ram guide 22.

The openings 17 and 25 of the primary ram guides 16 and 22, respectively, are non-circular in accordance with the present invention so as to effectively guide the outer rams 18 and 24, respectively, without the need for additional guide structure, such as guide posts, et cetera. Preferably, the non-circular openings include at least one non-circular portion, such as a flat side, although other structures are contemplated, so that movement around the longitudinal axis of the outer rams 18 and 24 is prevented by the shape of the outer rams 18 and 24 and the openings 17 and 25, respectively. In any case, a bearing structure is preferably provided to enhance movement as well as accurate alignment Referring again to the first component side 12, a middle ram 28 is illustrated which is movable within a passage 30 defined within the outer ram 18. A top hat portion 33 is provided at an inner end of the middle ram 28 for driving a forming component (not shown). The passage 30 is illustrated as cylindrical and sized to accommodate a portion 32 of the middle ram 28 for substantial sliding engagement. That is, the portion 32 of the middle ram 28 is guided by the inner surface of outer ram 18 defining the passage 30. Preferably, the diameter of the passage 30 is just slightly larger than the diameter of the portion 32 of the middle ram 28 so as to provide accurate sliding movement of the middle ram 28 through the outer ram 18.

Although the passage 30 is shown having a circular opening, it is understood that the passage 30 can comprise non-circular shapes as well. Moreover, although no bearing structure is illustrated between the middle ram 28 and the passage 30, a bearing structure, such as the one illustrated at 20 could be utilized, or any other configuration of bearings or bearing sleeves (i.e. a Teflon sleeve) depending on the outer shape of the middle ram 28 and the passage 30. For the reasons set out above, the use of needle bearings is advantageous; however, ball bearing structures may also be utilized.

In a similar sense, but with reference to the second component side 14, another middle rain 34 is provided to be guided within a passage 36 defined through the outer ram 24 of the second component side 14. Like the middle ram 28, the middle ram 34 preferably includes a portion 38 sized to accurately slide within the passage 36 and a top hat portion 40 for driving a forming component (not shown).

Alternatively, the middle ram 28 and enlarged portion 32 of the first component side 12 and/or the middle ram 34 and enlarged portion 38 of the second component side 14 may comprise a roller cage and die post assembly as are commercially known. The portions 32 and 38 may comprise sleeves that are movable over the middle rams 28 and 34 by way of a roller bearing cages positioned in-between. The sleeve portions 32 and 38 may then be fixed within the openings 30 and 36, e.g. by press fit, welds, adhesive, or the like, so that the middle rams 28 and 34 move therein. Top hats 33 and 40 can be conventionally attached to ends of die posts utilized in the making of the middle rams 28 and 34. Suitable commercial roller cage die post assemblies are available from Agathon Machine Tools Inc. of White Plains, N.Y.

As will be more fully detailed below, it is clear that the outer rams 18 and 24 can be longitudinally aligned with respect to one another to provide a first press forming operation. That is, the outer rams 18 and 24 can be moved simultaneously or independently toward one another, each being independently driven by an independent actuator (not shown). Such actuators may be hydraulic, pneumatic, electronic, mechanical, combinations of the above, or otherwise.

Then, within each of the outer rams 18 and 24, respectively, middle rams 28 and 34 can also be independently driven by actuators (not shown). Thus, a second forming operation can be accomplished either while the outer rams 18 and 24 are extended toward one another or otherwise. Primary ram guides 16 and 22 are preferably mounted to a support structure in a way to accurately longitudinally align the outer rams 18 and 24 and the middle rams 28 and 34. However, depending on the forming operation, it may be desirable to offset the longitudinal axis of the first component side 12 from that of the second component side 14 in any of the three dimensions. Moreover, it is contemplated that while the outer rams 18 and 24 may be preferably aligned with respect to one another, the middle rams 28 and 34 may be provided offset to one another. They may be offset similarly so that they will directly oppose one another, or they may be offset not only relative to the longitudinal axis of the outer rams 18 and 24 but also relative to one another.

Referring again to the first component side 12, an inner ram 42 is shown to be slidably guided within a passage 44 of the middle ram 28. Like the relationship of the middle ram 28 to the passage 30 of the outer ram 18, inner ram 42 and passage 33 may be modified in shape or to include bearing systems for the purposes of enhancing alignment. The inner ram 42 is illustrated in one possible orientation so as to be movable along the longitudinal axis of both the outer ram 18 and the middle ram 28. In any case, an end 46 of the inner ram 42 can be utilized independently for driving a forming component, as driven by its own actuator (not shown). The second component side 14 of the illustrated forming press 10 does not include a corresponding inner ram. Thus, actuation of the inner ram 42 of the first component side 12 may instead apply pressure against the top hat 40 of the middle ram 34 of the second component side 14, if extended during a forming operation. The inner ram 42 preferably also includes one or more guide bushings provided between it and the opening through the middle ram 28. Conventional post guide bushings that are suitable include oil impregnated bronze bushings, such as known under the trade designation "Oil Lite" bushings.

Not only is it contemplated that more actuators or rams may be provided on one side than the other, it is contemplated that more of such rams can be utilized in either side. Moreover, it is contemplated that more than one ram may be extendible from within another. For example, the outer ram 18 could instead be provided with two or more passages, each of which guide a middle ram, which themselves may be independently driven. The same arrangement also being possible for a plurality of inner rams extending through a middle ram.

Registration plates 48 and 50 are also illustrated including openings defined therethrough which are shaped and sized to closely fit over the outer surfaces of the outer rams 18 and 24. These registration plates 48 and 50 can then be fixed with any variety of forming elements, such as dies, or other metal forming components, including but not limited to clamping or part alignment features. Then, by fitting the registration plates accurately about the outer sides of the outer rams 18 and 24, near the front faces thereof, accurate alignment of the dies or forming components can be facilitated.

Figure 2:
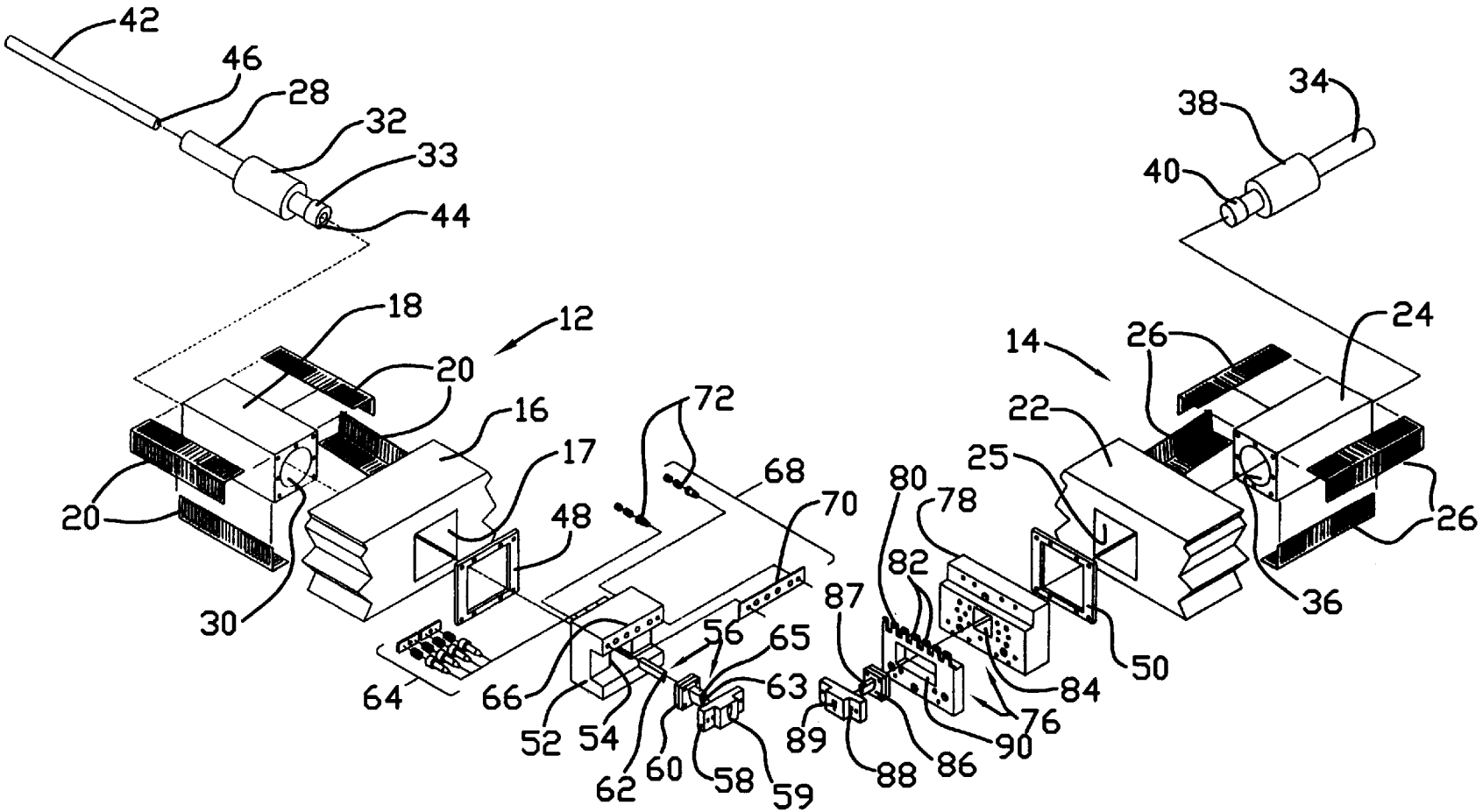
FIG. 2 is a schematic illustration similar to FIG. 1 but illustrating a specific use application in accordance with the present invention providing multiple actuations on both the first and second component sides.

Referring now to FIG. 2, a specific application usable in the formation of head suspensions, as described above in the Background section of this application, is illustrated utilizing the basic forming press components described just above. In particular, the illustrated embodiment is for performing a forming operation on head suspensions as provided attached to a carrier strip.

On the first component side 12, a first die 52 connects with the registration plate 48 so as to be driven by the outer ram 18. The first die 52 also includes a shaped opening 54 through which a punch assembly 56 can be moved. The punch assembly 56 is preferably sized to fit at least partially within the shaped opening 54 of the first die 52. In the illustrated case, opening 54 and component 60 are square. The punch assembly 56 comprises components 58, 60 and 62. Component 58 is preferably larger than the shaped opening 54 so that it will be driven with the first die 52, while components 60 and 62 will not Component 60 includes an opening 63 preferably sized to slidably guide the component 62 therein.

Component 58 preferably includes an opening 59 sized for slidably guiding portion 65 of component 60 therein.

Preferably, component 58 is conventionally secured with the first die 52. Component 60 fits within the shaped opening 54 so as to be driven by the middle ram 28. To move the component 60, the top hat 44 bumps against the component 60 to drive it forward as guided by the shaped opening 54 of the first die 52. To retract the component 60, a spring (not shown) can be provided acting to urge the component 60 in the direction of the primary ram guide 16. The component 60 is preferably not attached to the top hat 44 (but, may be) so that the bumping thereof by the top hat 44 does not influence its alignment. That is, it is the guiding by the shaped opening 54 that ensures alignment, and the top hat 44 merely pushes against the back surface of the component 60 wherever it hits. Another advantage of using the top hat 44 as a non-attached pusher is that the top hat 44 provides an increased surface area that can be used for pushing more than one component at the same time. The component 60 preferably moves with the middle ram 28 while portion 65 thereof is slidable within opening 59. Component 62 also fits within the shaped opening 54, but is positioned to slide within opening 63 and is preferably moved by the end 46 of the inner ram 42. The component 62 may be fixed to move with the inner ram 42 or may be bumped and retracted in a similar manner as described above with respect to the component 60 and top hat 44. As can be seen, component 58 thus moves with the outer ram 18, component 60 moves with middle ram 28, and component 62 moves with inner ram 42.

A plurality of alignment pins 64 are provided to extend from a front top face of the first die 52. The alignment pins 64 can be used to accurately position a carrier strip, such as used for the making of head suspensions, during the forming operation. A stripper mechanism 68 is also preferably provided including a stripper plate 70 and a pair of spring loaded supports 72. The spring load supports 72 are connected to the front face 66 of the first die 52 so that the stripper plate 70 is biased away from the front face 66. The stripper plate 70 also includes openings aligned to permit the alignment pins 64 to also extend therethrough.

On the second component side 14, a second die assembly 76 is provided. The second die assembly 76 comprises a first die portion 78 and a second die portion 80. The first die portion 78 can be connected to the registration plate 50 so as to move with the outer ram 24. The second die portion 80 is preferably fixed with the first die portion 78 and includes a series of notches 82 along its top surface to facilitate the alignment pins 64 and to enhance the working of the stripper mechanism 68 in use. A shaped opening 84 through the first die portion 78 permits the middle ram 34 to drive a component 86. Component 86 (like component 60 to top hat 44 described above) is preferably not attached to the top hat 40, but instead is bumped to move forward as the middle ram 34 is driven forward and can be retracted by any conventional means such as a spring (not shown) acting to pull component 86 back toward second primary ram guide 22. A component 88 preferably fits within a similarly shaped opening 90 of the second die portion 80 but is larger than the shaped opening 84 so that the component 88 is driven with the first die portion 78, second die portion 80 and the outer ram 24. Component 88 is preferably fixed to a face of the first die component 78. Opening 89 of component 88 preferably slidably guides a portion 87 of the component 86 therein.

The first and second component sides 12 and 14 are preferably aligned along a common longitudinal axis, and are preferably supported that way very accurately, such as by mounting the primary ram guides 16 and 22 on a common reference plane. A carrier strip having a plurality of head suspensions depending therefore can be conventionally driven through the forming press so that the head suspensions are positioned between the first and second component sides 12 and 14.

In operation, the outer rams 18 and 24 are initially driven forward so as to cause alignment pins 64 to locate the carrier strip 102 and thus the parts to be formed, followed closely by a clamping of the first die 52 and the second die assembly 76 with the carrier strip. At this time, components 58 and 88 clamp an aligned head suspension part therebetween. Also, the stripper plate 70 compresses the spring bias provided by supports 72 to lie against the face 66 of the first die 52. If precision is not needed or is adequately provided by the part transfer mechanism, the alignment pins 64 and use thereof can be eliminated.

Then, the middle rams 28 and 34 can be actuated to come together (preferably at the same time) so that the top hat 44 urges component 60 and its portion 65 forward against portion 87 of component 86 that is likewise driven forward by the top hat 40 of middle ram 34. This is done to perform a clamping and forming operation on the head suspension part clamped between components 58 and 88. Next, the inner ram 42 of the first component side 12 is driven forward to move component 62 through the opening 63 of the component 60, which itself is positioned within the opening 59 of component 58. The component 62 can be used to form a further feature on the head suspension part (or to remove or detab a rejected part, but only if needed) while the portion 87 of component 86 that extends within the opening 89 of component 88 provides a clamping function that includes a back pressure acting against the forming surface of the component 62. This clamping and back pressure are maintained by the middle ram 34. Then, after the forming step(s), each of the inner ram 42, middle rams 28 and 34, and outer rams 18 and 24 can be retracted in accordance with any desired sequence or at the same time. The result of moving the first die 52 back also permits the stripper plate 70 to be biased forward by its spring loaded supports 72 to thus strip the carrier strip from the alignment pins 64. The carrier strip can then be indexed forward so that a next similar operation can be done on a next part indexed into position.

With the above described operation, whether a single forming operation or more forming operations are performed, the multiple actuations on both the first and second component sides 12 and 14 permit all of the necessary clamping and aligning functions to be accomplished with a minimum of alignment structure. Certain of the multiple actuations take the place of other structure that has previously been relied upon in the prior art for performing the clamping and aligning function. With less structure, overall machine size can be advantageously significantly reduced.

Figure 3:
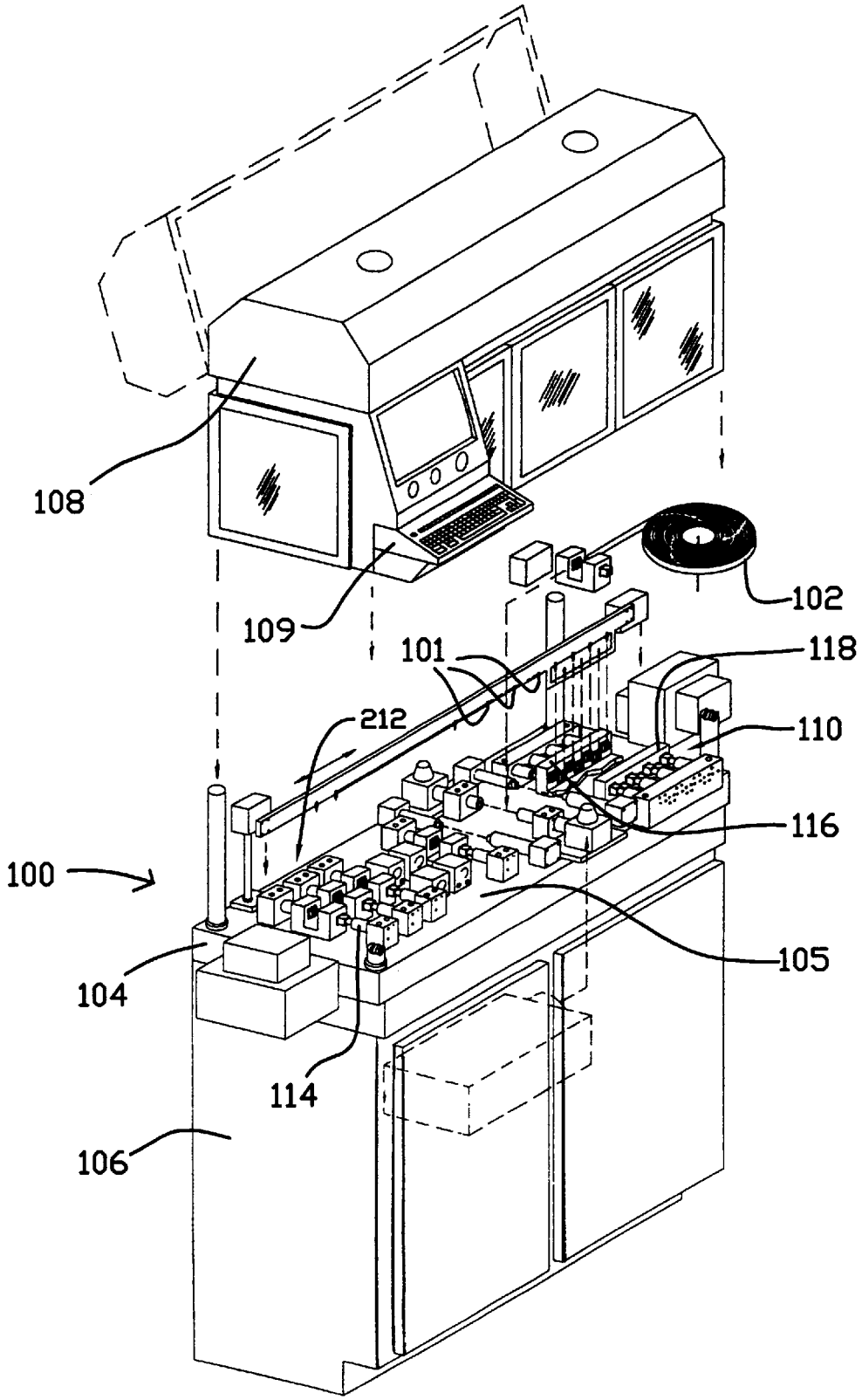
FIG. 3 is an isometric view of a machine providing a plurality of forming presses in accordance with the present invention provided in series for performing a number of metal forming steps on head suspensions provided on a carrier strip.

With reference to FIG. 3, a forming machine 100 is shown for performing multiple forming operations on head suspensions that are provided in the form of a carrier strip 102. The manner by which the head suspensions 101 and carrier strip 102 are indexed through the forming machine 100 will not be discussed in greater detail because any known or developed transport mechanism suitable for moving the carrier strip 102 through indexed stations can be utilized. The forming machine 100 comprises a main support 104 having a flat surface 105. Surface 105 is preferably machined to be very accurately flat A cabinet 106 supports the main support 104 in a substantially horizontal position, and further provides support for a cover assembly 108. As shown, the forming machine 100 may be computer controlled through a computer terminal 109 provided with the cover assembly 108. Such a computer can be conventionally connected with an electronic control system that may itself be further connected with a pneumatic or hydraulic control system, such systems not forming an integral part of the present invention and which can be designed according to known methods for specific applications.

In accordance with the present invention, a plurality of multiple action forming presses 110 are precisely mounted to the flat surface 105 of main support 104. Other forming presses 112 are also provided precisely mounted to the flat surface 105. The forming presses 112 may comprise multiple actuations, or may be single actuation forming stations. In any case, primary rams are preferably provided in the manner described above with respect to FIG. 1 which can be independently driven through actuators, such as shown at 114. These actuators can comprise any devices that are actuated hydraulically, pneumatically, electrically, mechanically, or by combinations thereof and the like.

A manner of driving the multiple actuations of a plurality of multiple actuation forming presses 110 is also illustrated in FIG. 3. Specifically, the primary ram guides for each of the primary rams are shown combined as primary ram guide plates 116 and 118. Moreover, the outer rams, one for each of the multiple actuator forming presses 110, are preferably connected together, for example by a link (not shown), so that upon actuation of a single actuator (not shown), the primary rams will all move forward or be retracted together. Then, the middle rams of each multiple actuation forming press 110 can be individually connected with its own actuator device. The middle rams can then be selectively advanced or retracted. Preferably, all of the outer rams for each side of the forming presses are moved together by a connecting link (not shown) while independent additional movements of the middle and inner rams (if provided) are controlled by separate actuators, such as air cylinders. By the forming machine 100, a relatively high number of forming operations can be performed on the top of the flat surface 105 of a single main support 104 of one forming machine 100. Clearly, this forming machine exhibits the advantage of being able to perform a large number of forming operations with reduced space requirements.

Another forming machine 200 is illustrated in FIGS. 4–8. The forming machine 200 includes the same basic components as shown in FIG. 1 and as provided in the forming machine 100. A main support 202 defines a vertically oriented flat surface 205 that extends sufficiently to define a first component side 212 and a second component side 214 of the forming machine 200. The main support 202 is supported in position by a plate 206 that is itself supported on vertical supports 208. Flanges 207 are preferably used to connect the main support 202 to the plate 206, while the plate 206 preferably sits atop the vertical support 208. Thus, the main support 202 and, in particular, its flat surface 205 can be effectively oriented as desired. Moreover, all additional structure of the forming machine 200 can then be supported by or from either the plate 206 or the main support 202.

A first primary ram guide 216 is mounted to the flat surface 205 of the main support 202 within the first component side 212. Any conventional mounting techniques can be utilized. As shown best in FIG. 7, first primary ram guide 216 is preferably made from an outer component 216*a*, a pair of side components 216*b*, and an inner component 216*c* so as to together define a non-circular opening 217. In the illustrated embodiment, the non-circular opening 217 is hexagonal. A first outer ram 218 is provided which is preferably similarly shaped as the non-circular opening 217 so as to be longitudinally slidable within the first primary ram guide 216. Moreover, the non-circular opening 217 is preferably sized with respect to the dimensions of the first outer ram 218 so that a plurality of needle bearing cages 220 can be advantageously provided therebetween to enhance guiding ease and accuracy. Preferably, as above, needle bearings are supported within the needle bearing cages 220 which are preloaded in position so as to enhance accuracy of movement of the first outer ram 218.

On the second component side 214, a second primary ram guide 222 is also conventionally mounted to the flat surface of 205 of the main support 202. The second primary ram guide 222 is also preferably made up of plural components like the first primary ram guide 216 so that when both the first primary ram guide 216 and the second primary ram guide 222 are mounted to the flat surface 205, they can be accurately aligned wit respect to one another. A second outer ram 224 is slidably received within a non-circular opening 225 defined by the second primary ram guide 222. Preferably, the outer shape of second outer ram 224 is similar to that of first primary ram guide 216. Moreover, a second set of needle bearing cages 226 are preferably provided in the same manner as needle bearing cages 220, discussed above, for guiding accurate movement of the second outer ram 224.

Figure 4:
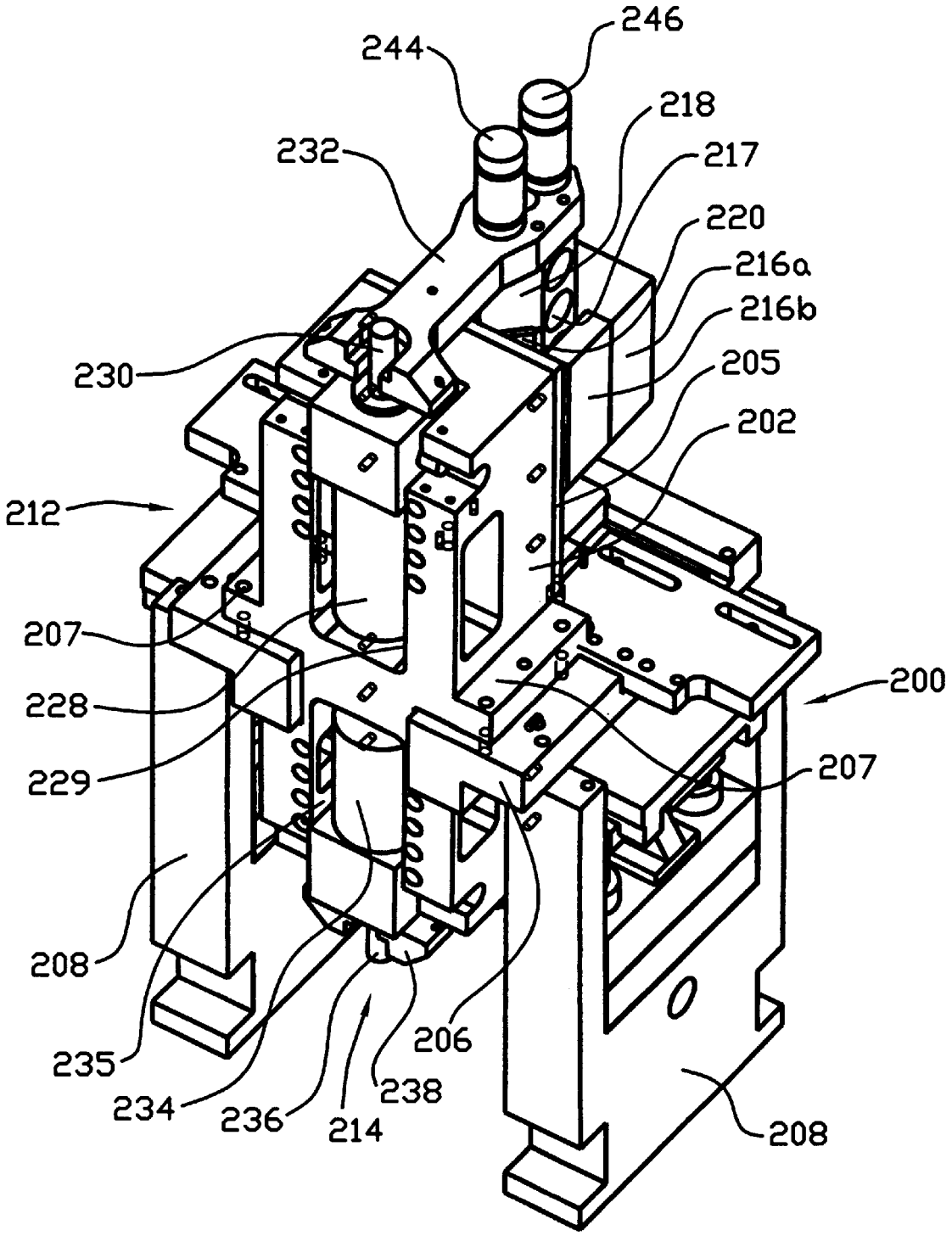
FIG. 4 is a rear isometric view of a different forming press also in accordance with the present invention, also having first and second component sides, each having multiple actuations.
Figure 5:
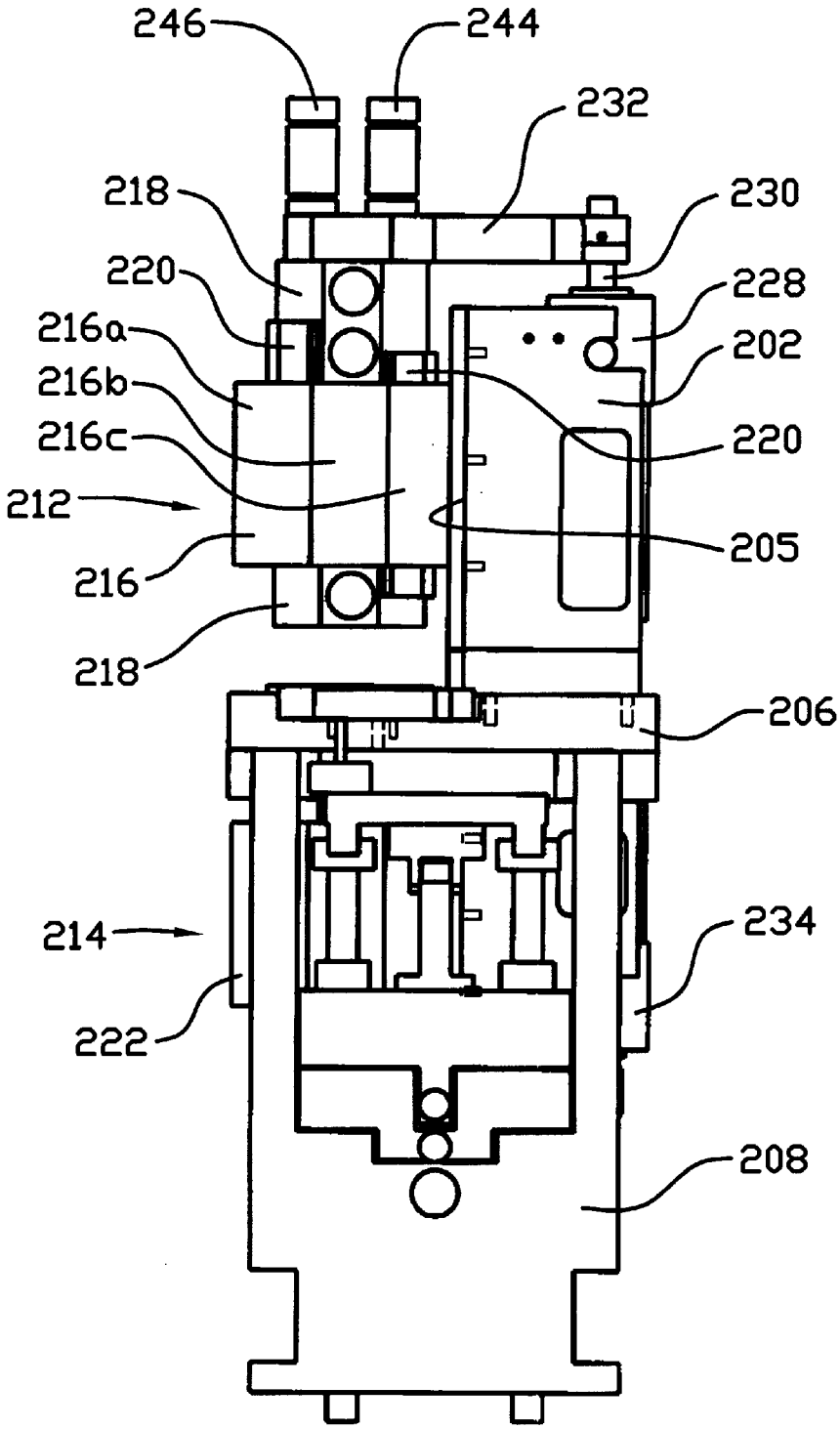
FIG. 5 is a side view of the apparatus of FIG. 4.
Figure 7:
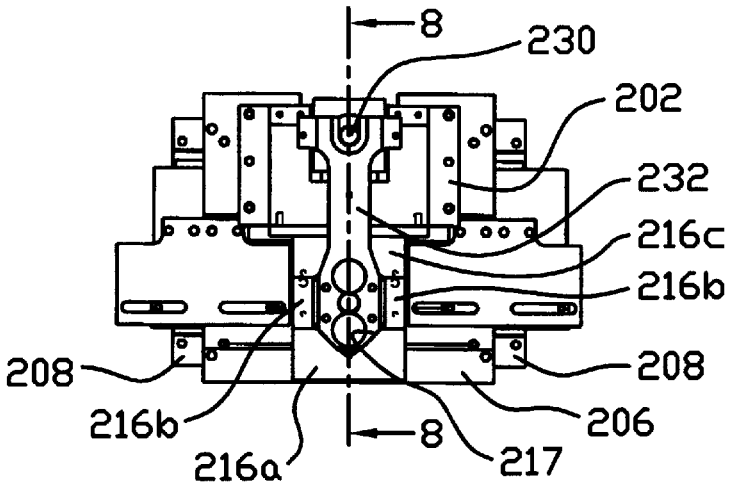
FIG. 7 is a top view of the apparatus of FIG. 4.
Figure 6:
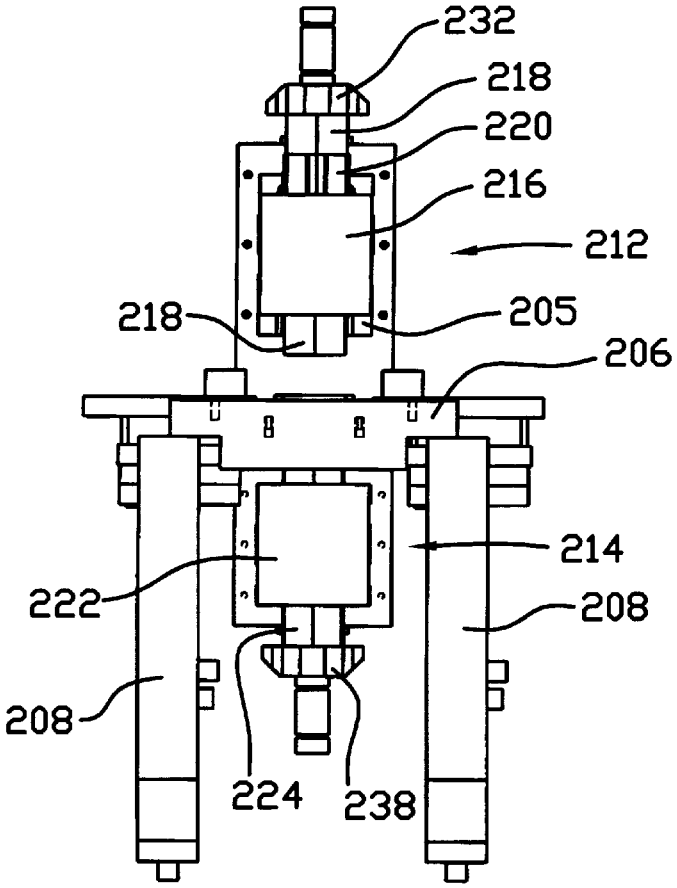
FIG. 6 is a front view of the apparatus of FIG. 4.
Figure 8:
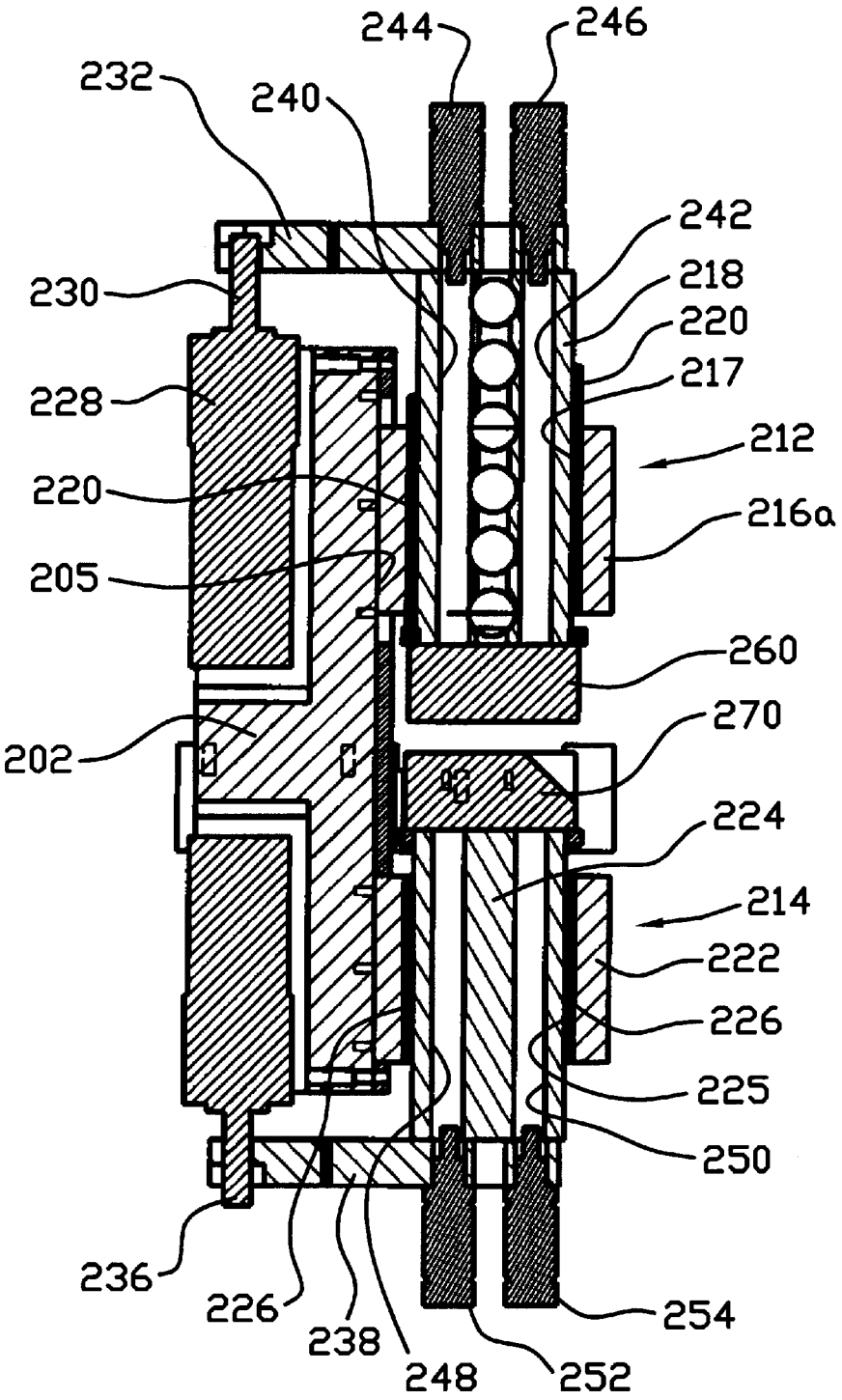
FIG. 8 is a cross-sectional view taken along line 8—8 in FIG. 7, but without the supporting structure.

In order to drive the first outer ram 218 between advanced and retracted positions, a first pneumatic cylinder 228 is provided. As shown in FIG. 4, the first pneumatic cylinder 228 is mounted within a recess 229 of the main support 202. The first pneumatic cylinder 228 is preferably mounted directly to the main support 202 within recess 229 so that its extendible and retractable piston 230 is connected with a first connecting arm 232, that is further connected to the first outer ram 218. As a result, when the piston 230 is extended from within the first pneumatic cylinder 228, the first outer ram 218 is retracted (that is, away from the forming area) by way of the first connecting arm 232. Retraction of piston 230 causes the first outer ram 218 to be extended toward the forming area A second pneumatic cylinder 234 is likewise supported within a recess 235 of the main support 202 on the second component side 214 of forming machine 200. Like the first pneumatic cylinder 228, the second pneumatic cylinder 234 is supported in position within the recess 235 so that its extendible and retractable piston 236 can be connected with a second connecting arm 238, which is in turn connected with the second outer ram 224. Thus, as the piston 236 is extended, the second outer ram 224 is retracted (away from the forming area) by way of the second connecting arm 238. Retraction of piston 236 causes the second outer ram 224 to be extended toward the forming area In order to provide for multiple actuations, first outer ram 218, as best shown in FIG. 8, is provided with a first passage 240 and a second passage 242. Passages 240 and 242 are longitudinally provided through the first outer ram 218, but are each offset from the longitudinal center axis of the first outer ram 218. A first actuator 244 is connected with the first connecting arm 232 so as to communicate with the first passage 240. Likewise, a second actuator 246 is connected with the first connector arm 232 to communicate with the second passage 242. First and second actuators 244 and 246 may be similar to one another or different from one another and can comprise actuators of the type having an extendible and retractable piston, like a typical pneumatic or hydraulic cylinder, or may comprise control valves or sources of fluid which can communicate with the respective passages 240 and 242.

Figure 8A:
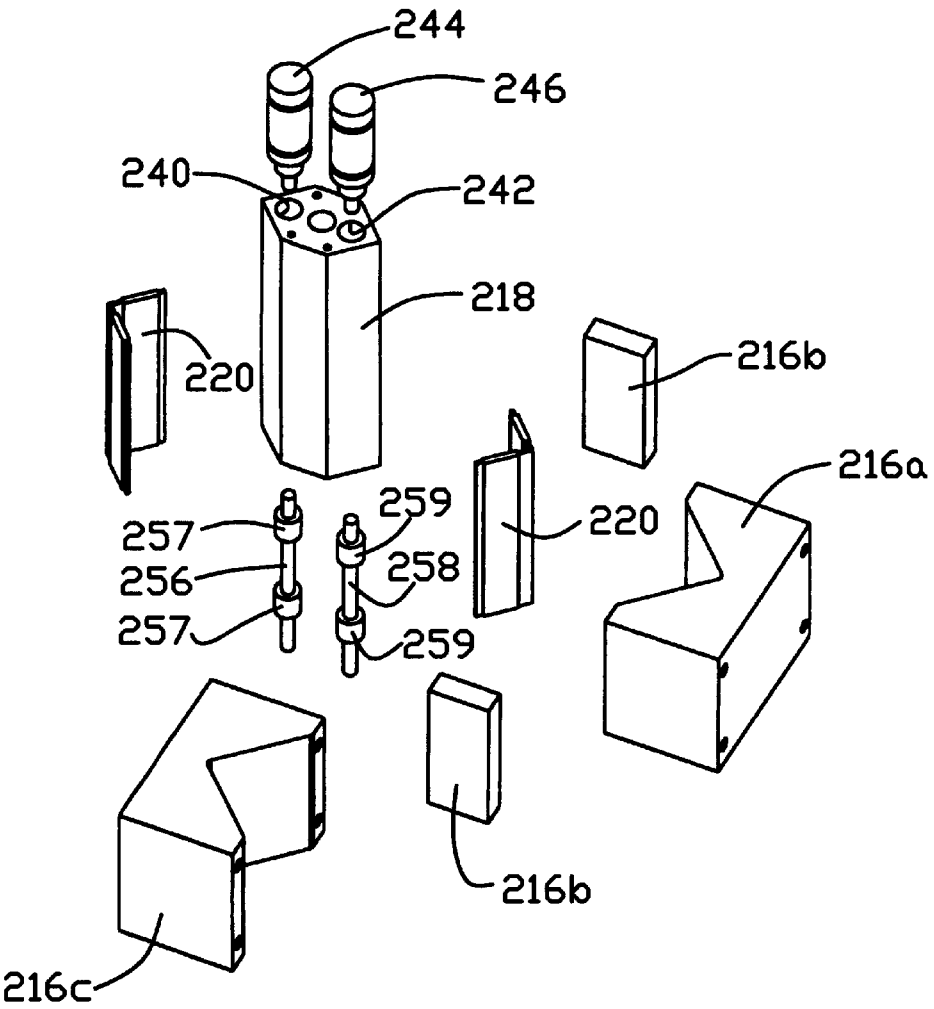
FIG. 8A is an exploded view, with components in perspective, of a first component side ram and guide assembly of the apparatus of FIG. 4.

In the case of the latter, as shown in FIG. 8A, the passages 240 and 242 should be sufficiently closed so that slidable rams 256 and 258 can be provided within passages 240 and 242 so as to define pressure chambers within the passages 240 and 242 for operatively moving the slidable rams 256 and 258 between advanced and retracted positions. Sleeves 257 and 259 are preferably provided for accurate guiding of the slidable rams 256 and 258, respectively. Sleeves 257 and 259 may be fixed with the rams 256 and 258 so as to move therewith within the passages 240 and 242, respectively, or may themselves be fixed within the passages 240 and 242 so that the rams 256 and 258, respectively, can move therein. The sleeves may comprise oil impregnated bushings or roller cages, both discussed above, or any other guiding devices. Then, these rams 256 and 258 can be connected with forming components usable within the forming operation of the forming machine 200. Illustrated in FIG. 8 is a block 260 which schematically represents any number of forming, clamping and/or part aligning structures or components. Components equivalent in function to components 52, 56, 58, 76, 86, and 88 of FIG. 2, for example, may be provided. Moreover, openings and inner rams may be provided such as in the manner of middle rams 28 and 34 and inner ram 42 of FIG. 2.

In order to also make the second component side 214 with multiple actuations, the second outer ram 224 is provided with first and second longitudinal passages 248 and 250. Actuators 252 and 254 are connected to the second connecting arm 238 so as to communicate with passages 248 and 250. Preferably, actuators 252 and 254 are similar to one another and can comprise either extendible and retractable cylinders, or the like, themselves, or may act as a control or fluid source for utilizing the passages 248 and 250 as chambers of cylinders themselves that can drive sliding rams (like sliding rams 256 and 258, discussed above) within the passages 248 and 250 in the same manner as described above with respect to first outer ram 218.

Thus, in the same manner as the embodiments described above, multiple actuations within a single forming press can be effected. Outer rams 218 and 224 can be independently advanced and retracted. Actuators 244, 246, 248 and 254 can each individually be controlled to cause the advancing or retracting of any particular forming component operatively associated therewith. As above, the multiple actuations can be used for various means within a forming process, such as for clamping, aligning or performing multiple forming operations. Preferably, in the case of forming head suspensions provided on a carrier strip, the forming machine 200 also includes structure for indexing the head suspensions through the machine in accordance with the particular forming functions being performed. As also illustrated in FIG. 8 a block 270 schematically represents any number of forming, clamping and/or part aligning structures or components. Components equivalent in function to components 52, 56, 58, 76, 86, and 88 of FIG. 2, for example, may be provided. Moreover, openings and inner rams may be provided such as in the manner of middle rams 28 and 34 and inner ram 42 of FIG. 2.

As noted above, the first primary ram guide 216, as well as the second primary ram guide 222, preferably comprise a multi-component construction. As shown best in FIG. 7, components 216*a* and 216*c* can be similar to one another so as to guide the first outer ram 218, and are separated from one another by a pair of components 216*b*. Having wedge-shaped surfaces defined longitudinally along the components 216*a* and 216*c*, these components provide the primary guiding surfaces on which needle bearing cages 220 can ride. Surfaces of components 216*b* need not be utilized for guiding the movement of the first outer ram 218, but the components 216*b* are used to accurately define the spacing between the wedge-shaped surfaces of components 216*a* and 216*c*. This is beneficial in that adjustments to the spacing can be easily made by either installing larger components 216*b*, by installing smaller components 216*b*, or by modifying existing components 216*b*. For example, if after installation, it is determined that insufficient preloading is provided to the needle bearings within the needle bearing cages 220, components 216*b* can be removed and replaced, or they may be slightly machined to a smaller dimension, and then reinstalled. This will result in a smaller opening between the wedge-shaped surfaces of the components 216*a* and 216*c*, which can be advantageously used to increase the preload of the needle bearings. Moreover, over time, it may be necessary to adjust the preload. Such can be accomplished in the same way. This same ability applies as well to the second primary ram guide 222.

However, it is understood that the primary ram guides 216 and 222 need not comprise multiple components, or may comprise more or less components. Moreover, it is contemplated that other shapes for the non-circular openings 217 and 225 can be defined with single component structure primary ram guides or multiple component structures. Like the embodiments above, it is, however, preferred that the openings 217 and 225 be non-circular (or at least include a non-circular portion, such as a flat portion) so that needle bearings can be utilized for accuracy of movement and alignment.

Yet another forming machine 300 is illustrated in FIGS. 9–37. A main support plate 302 divides the forming machine 300 into a first component side 304 and a second component 306. As shown best in FIGS. 9 and 13, the main support plate 302 provides the support having a surface 303 upon which the first component side 304 is provided and a second surface 305 to which the second component side 306 is suspended. By this construction, only the main support plate 302 need be further supported in position, such as by conventional support legs (not shown) maintaining the main support plate 302 at a specified location above and along a floor surface, for example. Preferably, a plurality of support legs are fixed to the main support plate 302 so as to orient the main support plate 302 horizontally. With this construction, the first and second component sides 304 and 306 need then to be accurately aligned with regard to one another so as to provide accurate forming operations. Preferably, a jig mechanism is rigged to ensure the accurate alignment of the component sides relative to one another. As shown best in FIG. 19, the main support plate 302 includes a center opening 308 to facilitate forming operations.

Figure 19:
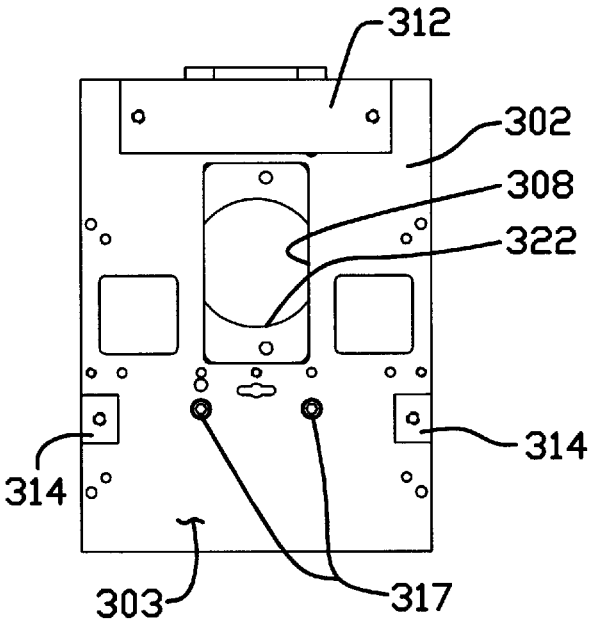
FIG. 19 is a top view of the mounting pate assembly of FIG. 17.
Figure 17:
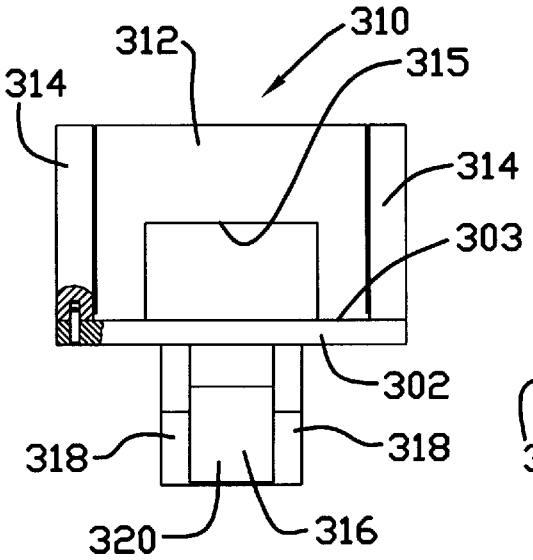
FIG. 17 is a front view of a mounting plate assembly which supports the first and second component sides of the forming press shown in FIG. 9.
Figure 18:
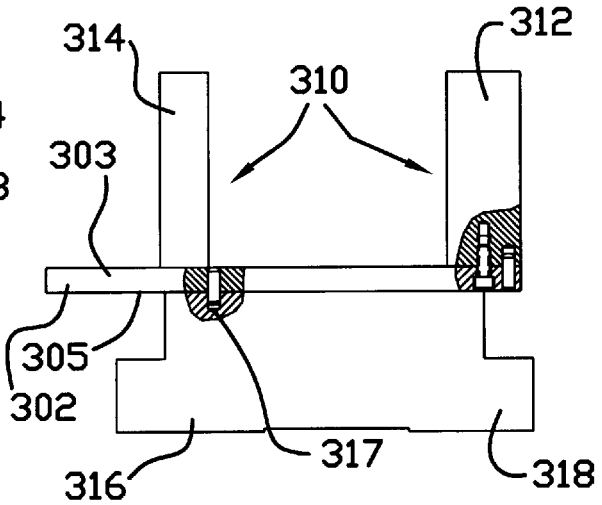
FIG. 18 is a side view of the mounting plate assembly of FIG. 17.
Figure 22:
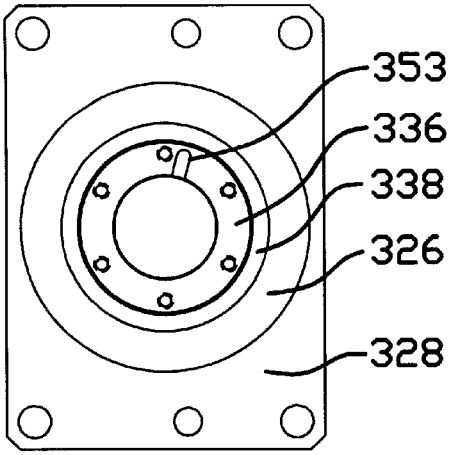
FIG. 22 is a top view of the first component side ram guide subassembly of FIG. 21.
Figure 23:
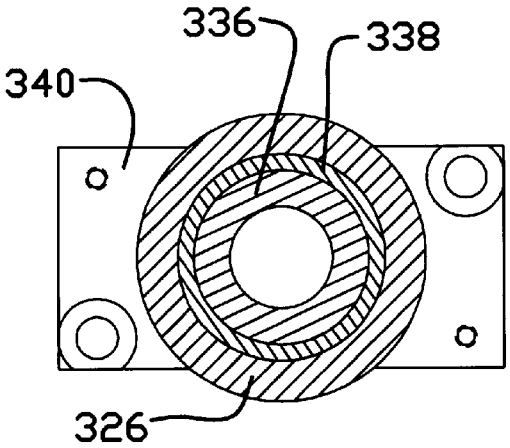
FIG. 23 is a cross-sectional view taken along line 23—23 of FIG. 20.
Figure 21:
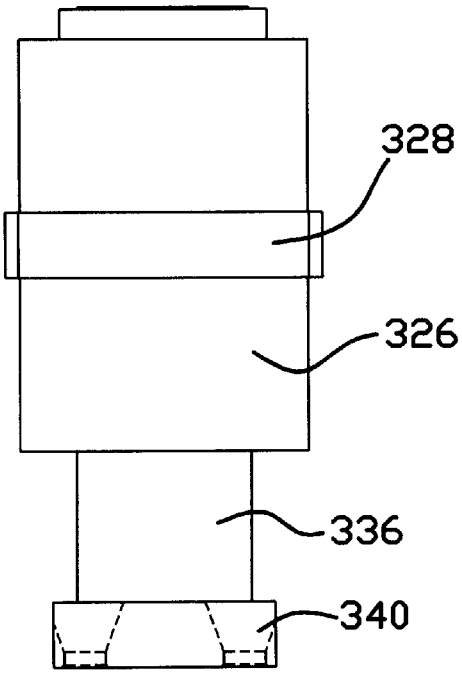
FIG. 21 is a side view of the first component side ram guide subassembly of FIG. 20.
Figure 20:
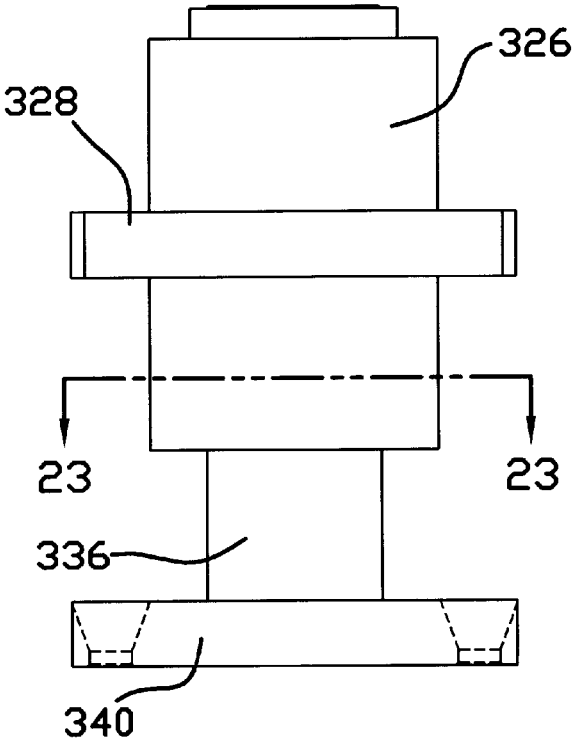
FIG. 20 is a front view of the first component side ram guide subassembly for the forming press of FIG. 9.
Figure 26:
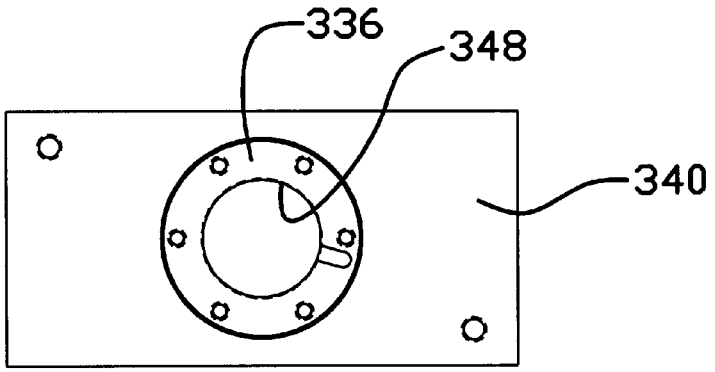
FIG. 26 is a top view of the first outer ram of FIG. 24.
Figure 24:
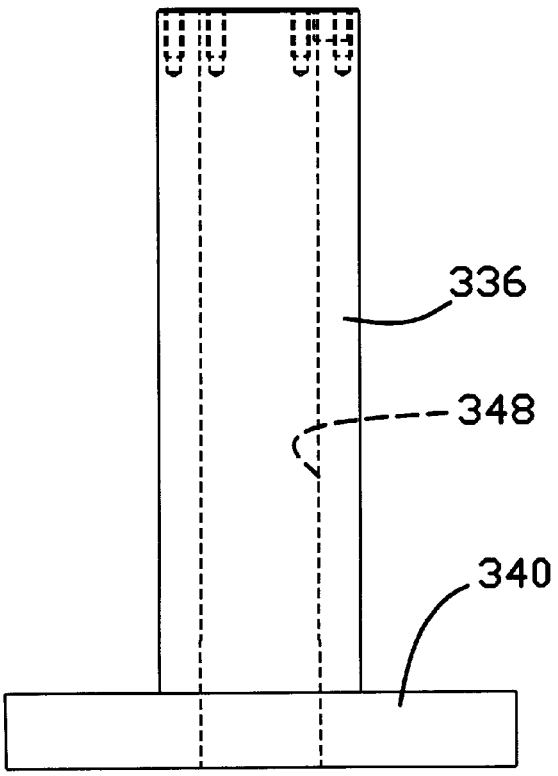
FIG. 24 is a front view of a first outer ram of the first component side ram guide subassembly.
Figure 25:
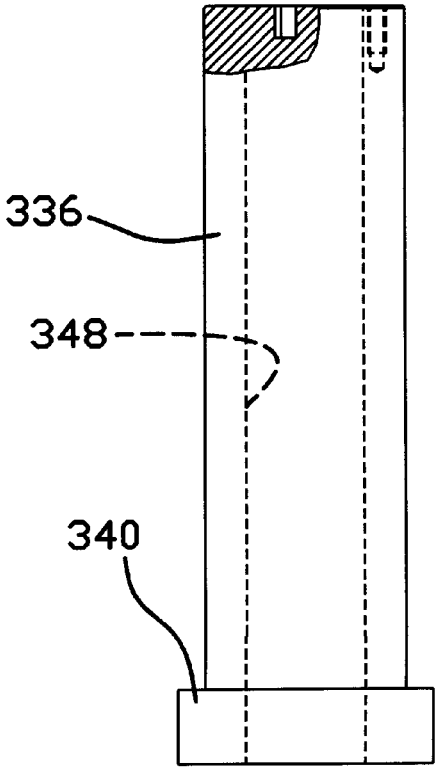
FIG. 25 is a side view of the first outer ram of FIG. 24.

A first component side guide structure 310 is illustrated in FIGS. 17–19 mounted to the first side 303 of the main support plate 302. The first component side guide structure 310 preferably comprises a top rear standoff 312 and a pair of top front posts 314. Preferably, the top rear standoff 312 comprises a single element having an opening 315; however, it is understood that the top rear standoff 312 may instead comprise plural components. Likewise, the top front posts 312 may be made as a single component or more than two parts.

As also shown in FIGS. 17 and 18, a bottom guide plate 316 is attached to the surface 305 of the main support plate 302. As shown, conventional screws 317 can be utilized for connecting the bottom guide plate 316 to the main support plate 302. The bottom guide plate 316 is preferably a unitary construction and provides a pair of side portions 318 connected together by a central web 320. Within the central web 320, an opening 322 (see FIG. 19) is provided to facilitate the forming operation, as will be described below. Again, it is understood that the bottom guide plate 316 may instead comprise multiple components and be of different shapes.

With reference back to FIG. 13, the top rear standoff 312 and the top front posts 314 support a top guide plate 324 so as to be oriented preferably substantially parallel with the main support plate 302, but spaced therefrom by the top rear standoff 312 and top front posts 314. The top guide plate 324 also includes an opening (not shown) so as to provide support for a first primary ram guide 326. The top guide plate 324 may otherwise be constructed of plural components that define a supporting structure for the first primary ram guide 326.

The first primary ram guide 326 is preferably provided with a flange 328, by which the first primary ram guide 326 can be connected to the top guide plate 324, such as by conventional screws 329. The first primary ram guide 326 also preferably extends at least partially through the opening (not shown) of the top guide plate 324. This connection is preferably controlled so as to very accurately position the first primary ram guide 326 for aligning the forming components of the first component side and for operation as described below. Conventional adjustment techniques can be incorporated within the mounting, such as by way of bolts and slots.

On the second component side 306, a second primary ram guide 330 is preferably similarly supported by the bottom guide plate 316. That is, a flange 332 is preferably provided with the second primary ram guide 330 and is accurately connected to the bottom guide plate 316 by conventional screws 333, wherein adjustment may also be provided. The second primary ram guide 330 also preferably extends at least partially through the opening 322 of the central web portion 320 of the bottom guide plate 316. As can be appreciated from this construction, accurate longitudinal alignment (whether offset or not) of the first primary ram guide 326 with the second primary ram guide 330, facilitates accurate forming operations, including multiple actuations from both the first and second component sides 304 and 306, respectively, as will be described below. Preferably, the first and second primary ram guides 326 and 330 are longitudinally aligned along a common longitudinal axis; however, it is understood that many variations are also usable, such as where the longitudinal axes are deliberately offset relative to one another.

Figure 15:
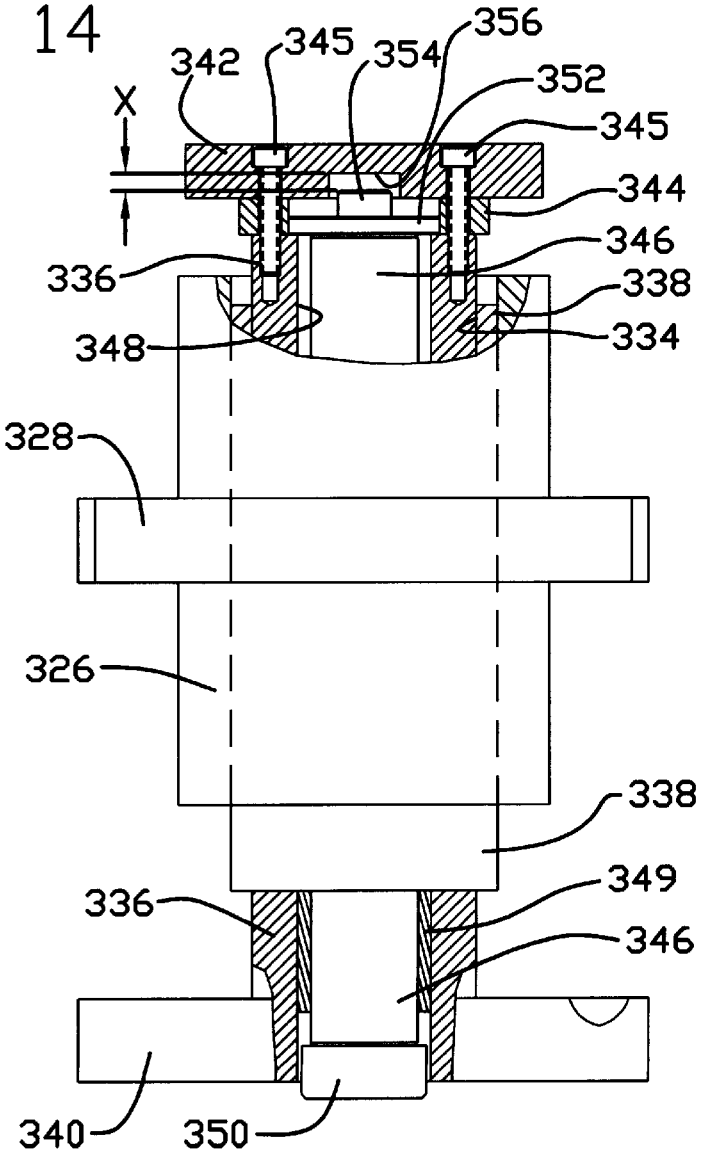
FIG. 15 is an enlarged front view of the first component side of the forming press of FIG. 9 contained within the chain line oval D of FIG. 13.
Figure 29:
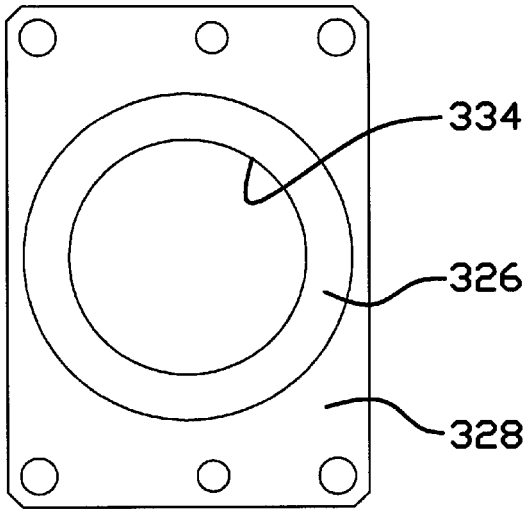
FIG. 29 is a top view of the primary ram guide of FIG. 28.
Figure 28:
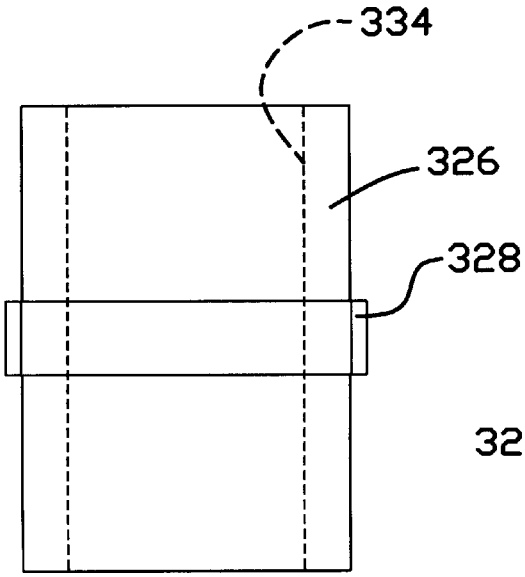
FIG. 28 is a side view of the primary ram guide of FIG. 27.
Figure 27:
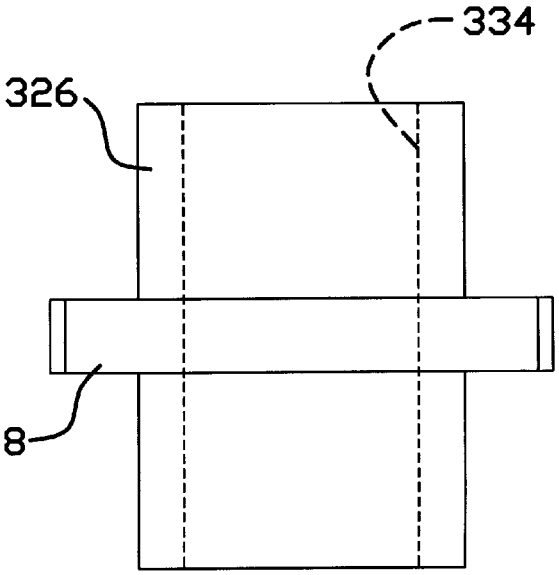
FIG. 27 is a front view of the primary ram guide of the first component side ram guide subassembly.
Figure 32:
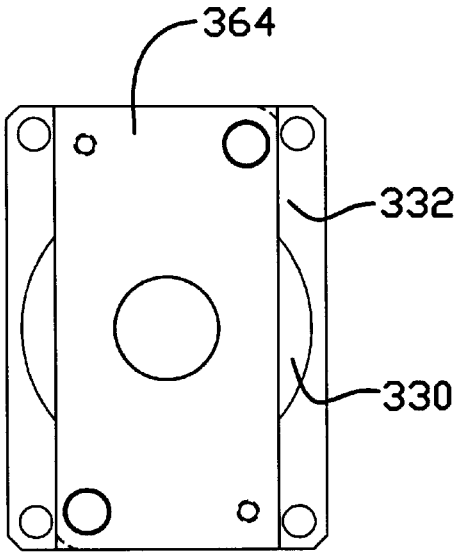
FIG. 32 is a top view of the second component side ram guide subassembly of FIG. 31.
Figure 33:
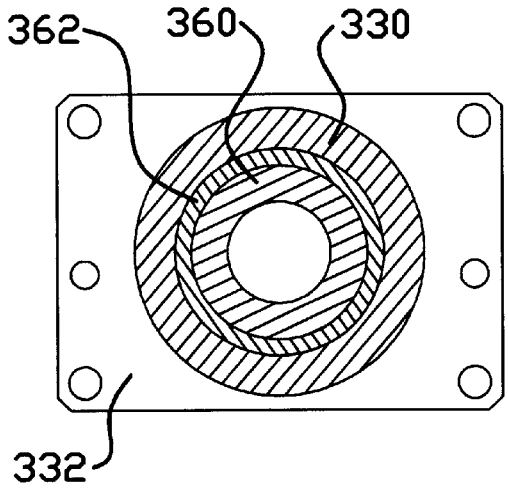
FIG. 33 is a cross-sectional view taken along line 33—33 of FIG. 30.
Figure 31:
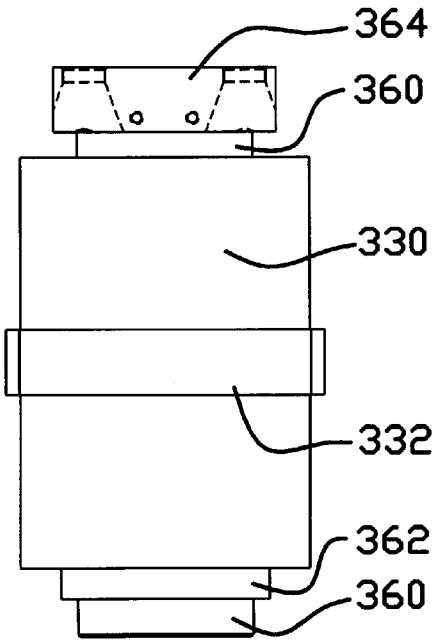
FIG. 31 is a side view of the second component side ram guide subassembly of FIG. 30.
Figure 30:
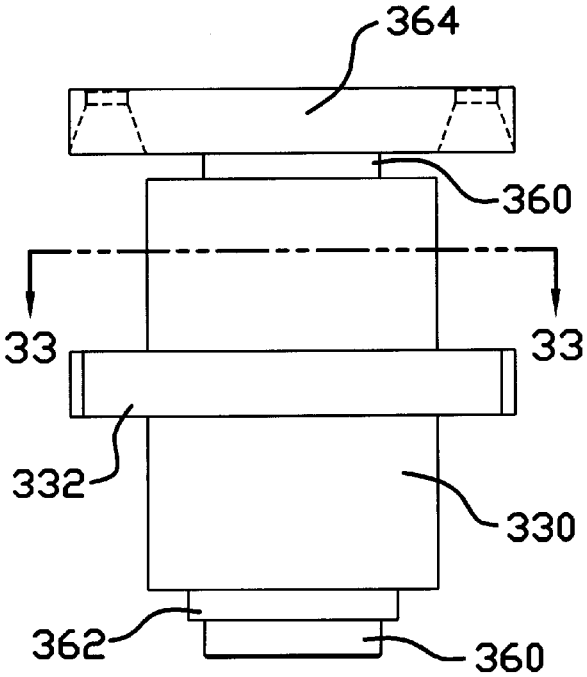
FIG. 30 is a front view of the second component side ram guide subassembly for the forming press of FIG. 9.
Figure 34:
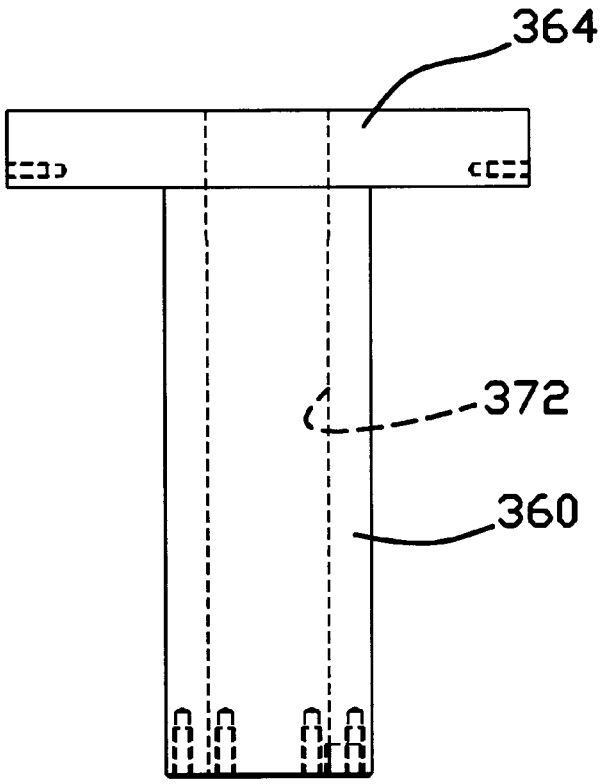
FIG. 34 is a front view of a second outer ram of the second component side ram guide subassembly.
Figure 35:
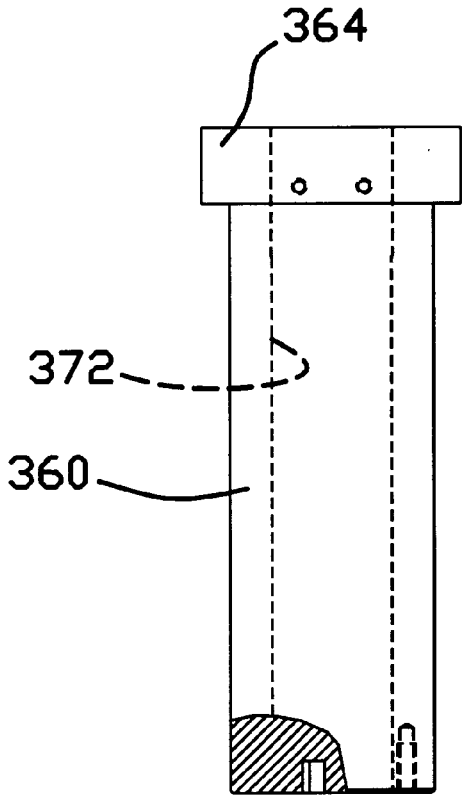
FIG. 35 is a side view of the second outer ram of FIG. 34.
Figure 36:
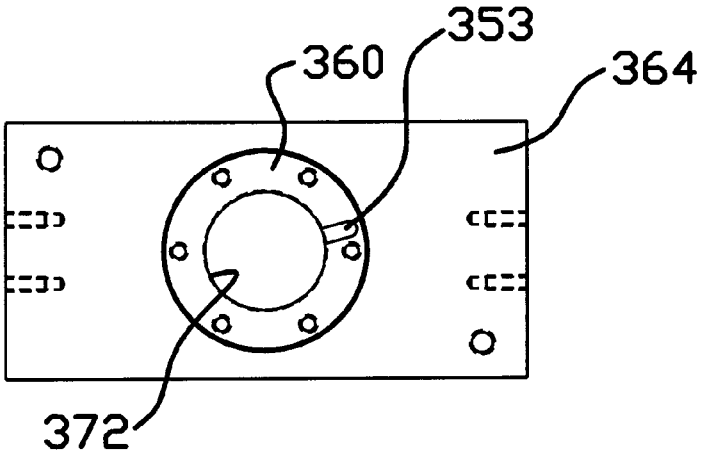
FIG. 36 is a top view of the second outer ram of FIG. 34.
Figure 39:
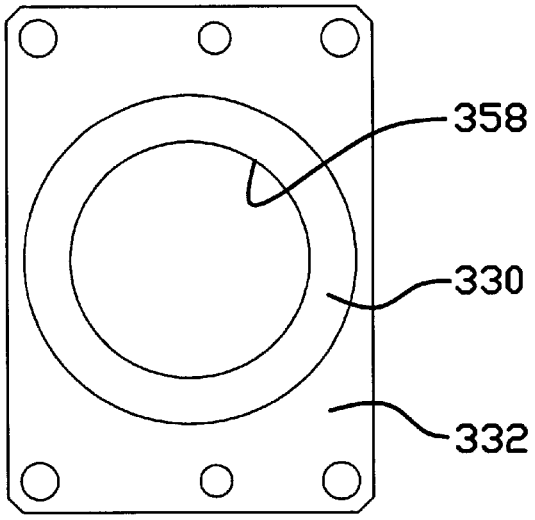
FIG. 39 is a top view of the primary ram guide of FIG. 38.
Figure 38:
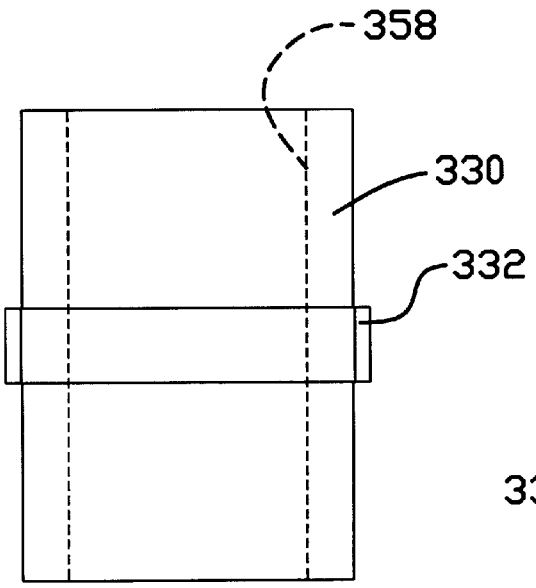
FIG. 38 is a side view of the primary ram guide of FIG. 37.
Figure 37:
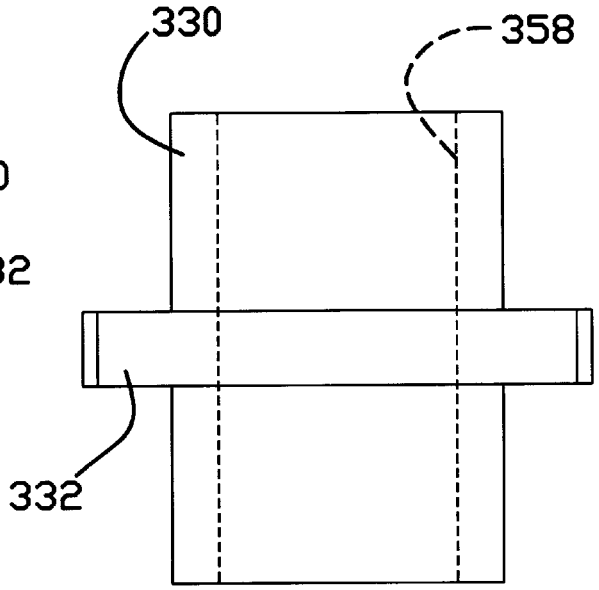
FIG. 37 is a front view of the primary ram guide of the second component side ram guide subassembly.

With reference to FIG. 15, the first primary ram guide 326 is shown removed from the forming machine 300. In addition, FIGS. 27–29 show the first primary ram guide 326 as a separate component provided only with the flange 328. Extending preferably longitudinally through the first primary ram guide 326, is a throughbore 334. As shown in FIG. 29, the throughbore 334 can be circular in cross-section; however, it is preferable that the throughbore 334 include at least some non-circular component along its surface and extending longitudinally throughout so as to provide a surface over which a bearing structure can ride, as will be more fully described below. Like the above embodiments, the provision of a flat surface advantageously facilitates the use of needle bearings that can be sufficiently preloaded to enhance accuracy of movement of components. Plural shaped portions, preferably flat surfaces, are most preferably desired about the circumference of throughbore 334 so that preloading can be applied evenly about the throughbore 334 for accurate guiding.

Figure 41:
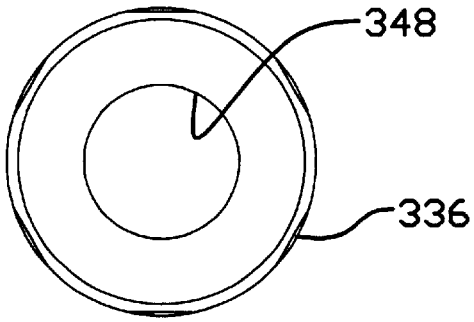
FIG. 41 is a top view of a preferred outer ram configuration providing plural flattened needle bearing surfaces.
Figure 42:
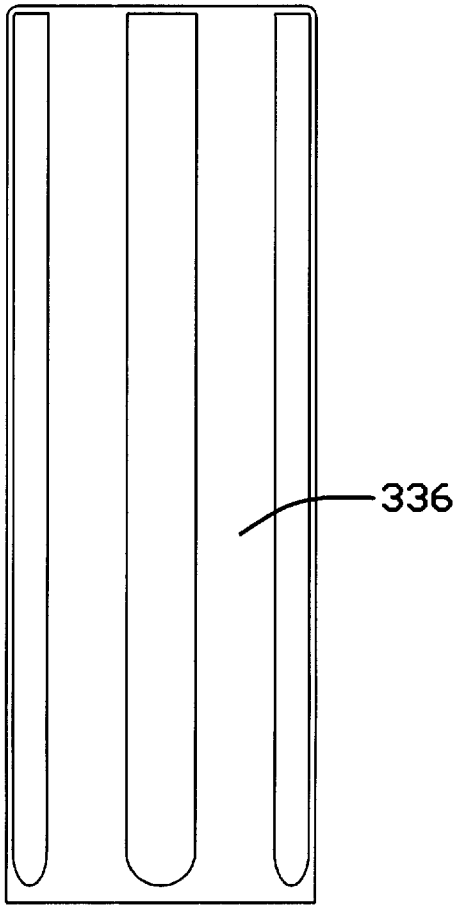
FIG. 42 is a side view of the preferred outer ram of FIG. 41 showing the flattened surfaces extending substantially over the length of the outer ram.
Figure 43:
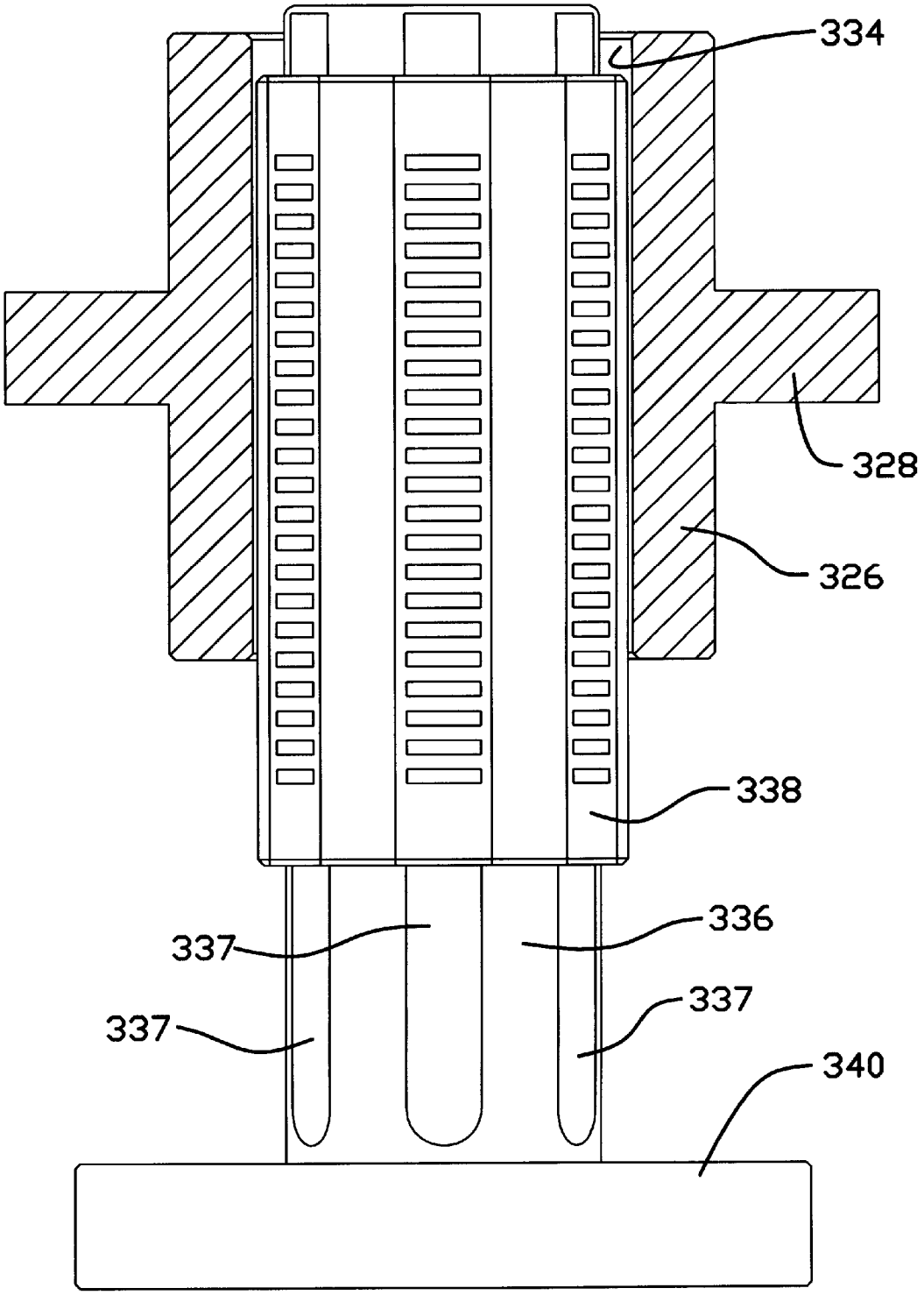
FIG. 43 is a partial cross-sectional view of a preferred ram guide subassembly showing needle bearings provided within cages between a primary ram guide having flattened surfaces arranged about its throughbore and an outer ram having corresponding flattened surfaces.

As shown in FIG. 15, a first outer ram 336 is guided within the throughbore 334 of the first primary ram guide 326. Between the first outer ram 336 and the throughbore 334, a bearing cage 338 is preferably provided to provide smooth easy movement of the first outer ram 336 within the throughbore 334. The bearing cage 338 preferably supports a plurality of bearings completely around the outer surface of the first outer ram 336, and most preferably includes needle bearings that ride between complimentary flat surface portions of the outer surface of the first outer ram 336 and the inner surface defining the throughbore 334. Bearing cage 338 preferably extends substantially longitudinally within the throughbore 334, and may comprise a single bearing cage or multiple bearing cages stacked along the length of the first outer ram 336. In FIGS. 41, 42 and 43, a preferred six-sided outer ram 336 configuration providing plural flattened needle bearing surfaces 337 is illustrated. The flattened surfaces 337 preferably extend substantially over the length of the outer ram 336. As shown in FIG. 43 needle bearings are conventionally supported within bearing cage 338 so as to ride on the flattened surfaces 337 of the outer ram 336 as well as corresponding flattened surfaces of the primary ram guide 326 arranged about its throughbore 334.

Mounted to a bottom end of the first outer ram 336 is a forming die support plate 340. This forming die support plate 340 can be of any desired shape and have whatever features are necessary in order to connect with a forming die or other forming component (for example, clamping or aligning structure) and that are useful in accordance with the present invention. Alternatively, the support plate 340 may itself include features of a forming die to be used in accordance with the present invention. Thus, longitudinal movement of the first outer ram 336 is effectively and accurately guided so that the forming die support plate 340 can be positioned between forming and non-forming positions.

At the top end of the first outer ram 336, a top stop 342 is connected by way of an annular spacer 344 to the top end of the first outer ram 336. Conventional screws 345 can be used for this purpose. The functions of the top stop 342 will be apparent from the description below.

To provide multiple actuation, a first inner ram 346 is disposed within a longitudinal throughbore 348 extending through the first outer ram 336. Preferably, bushings 349 are provided between an outer surface of the first inner ram 346 and the surface defining the longitudinal throughbore 348. Bushings 349 may be conventional bushing material or may comprise a bearing cage such as those described above, to facilitate accurate movement of the first inner ram 346 within the longitudinal throughbore 348. First inner ram 346 can be circular in cross-section or may include one or more non-circular features to facilitate the use of bearings, for the same reasons as discussed above.

At the bottom end of the first inner ram 346, a forming button 350 is preferably provided which is usable in any forming operation in accordance with the present invention. That is, the forming button 350 provides a second actuatable forming operation in addition to that which may be performed by the first outer ram 336 with its forming die support plate 340. Forming button 350 may itself be provided with features of a specific forming operation, or may be further connected with other components or forming dies.

At the top end of the first inner ram 346, a piston 352 is attached. The piston 352 is provided in order to permit actuation of the first inner ram 346. As shown in FIG. 15, the annular spacer 344 preferably defines an inside diameter that is greater than the diameter of the longitudinal throughbore 348. The piston 352 is preferably shaped similar to the opening defined within the annular spacer 344 and is sized so as to sealingly slide therealong. A top reduced diameter portion 354 of the first inner ram 346 is shown extending through the piston 352 and positioned within a slightly larger depression 356 of the top stop 342 that extends partially through the thickness thereof. By this construction, the first inner ram 346 is movable longitudinally within the throughbore 348 as actuated by the piston 352 (the activation of which will be described below) which is in turn fixed thereto. The piston 352 is moveable within the opening of the annular spacer 344 by an amount X defined between a top surface of the reduced diameter portion 354 and the surface of the depression 356 of the top stop 342.

Figure 40:
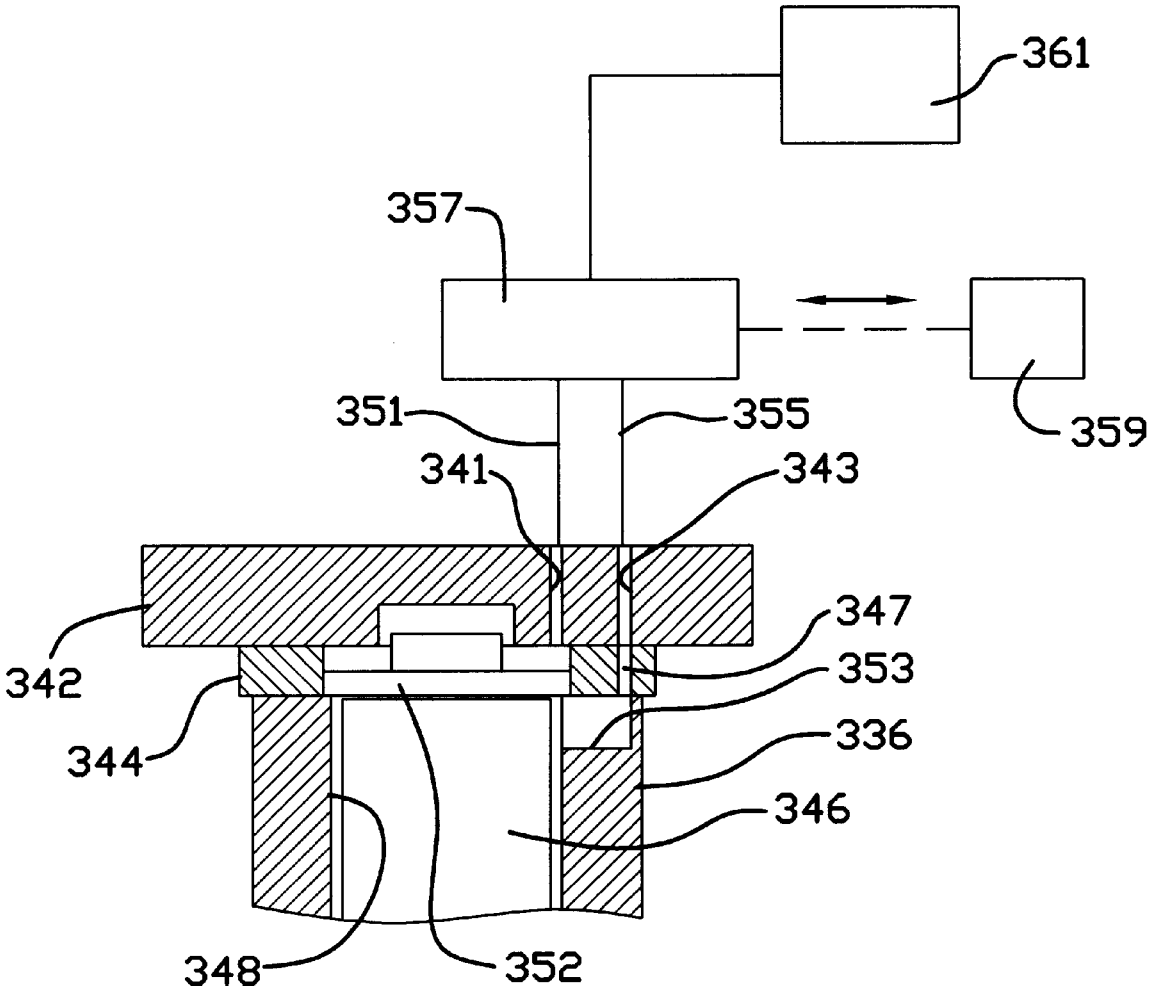
FIG. 40 is a partial cross-sectional view similar to FIG. 15 schematically showing a fluid supply and exhaust system.

In order to actuate the first inner ram 346, fluid can be selectively introduced into one of two chambers defined at opposite sides of the piston 352. For example, in order to position the first inner ram 346 in an extended position, as illustrated in FIG. 15, pressurized fluid, preferably air, can be supplied to the chamber defined above piston 352, within the opening of the annular spacer 344 and below the top stop 342. To retract the first inner 346, fluid may be exhausted from the first defined chamber and fluid may be introduced within a second chamber defined below the piston 352, within the longitudinal throughbore 348 and the opening of the annular spacer 344, and above the bushing 349. A pneumatic system is preferred because fluid leakage between piston 352 and annular spacer 344 can be permitted to occur without spillage or other fluid handling problems. As shown in FIG. 40, the top stop 342 can have a passage 341 that is in fluid communication with a line 351 that can be used to supply or exhaust fluid to and from the chamber above piston 352. Fluid access for supply and exhaust is provided to the chamber below piston 352 by way of a second passage 353 through top stop 342, a passage 347 through annular spacer 344 that is aligned with passage 353, and a slot 353 defined within the top wall of the first outer ram 336. Passage 343 is in fluid communication with a line 355 that can also be used to supply or exhaust fluid. Lines 351 and 355 are schematically illustrated connected to a shifting valve body 357 that is controllable by any known or developed positioning means 359 so that lines 351 and 355 are selectively connectable to a fluid source 361.

Alternatively, the first inner ram 346 can be operatively connected to any other type of conventional actuator to move it between extended and retracted positions. Such an actuator could be mounted to the first outer ram 336 so as to extend an extendible and retractable piston within the throughbore 348 thereof.

The range of movement of the first outer ram 336 is defined by the top stop 342 and the support plate 340. That is, a bottom surface of the top stop 342 (as viewed in FIG. 15) will abut a top surface of the first primary ram guide 326 when the first outer ram 366 is entirely extended. When the first outer ram 366 is entirely retracted, a top surface of the support plate 340 will contact a bottom surface of the first primary ram guide 326. The difference between the distance from the bottom surface of the top stop 342 to the top surface of the support plate 340 and the distance from the top surface of the first primary ram guide 326 to the bottom surface of the first primary ram guide 326 defines the range of movement of the first outer ram 336 relative to the first primary ram guide 326.

On the second component side 306, similar components are provided. Specifically, the second primary ram guide 330 is mounted to the bottom guide plate 316 by flange 332. Conventional screws 333 can be used. A preferably longitudinal throughbore 358 is provided through the second primary ram guide 330 in order to guide a second outer ram 360 to move longitudinally between extended and retracted positions. Also, preferably between the inner surface defining throughbore 358 and the outer surface of second outer ram 360, a bearing cage 362 is provided in order to facilitate accurate alignment and easy sliding movement of the second outer ram 360. Like the first outer ram 336, bearing cage 338, and the throughbore 334 of the first primary ram guide 326, the outer surface of the second outer ram 360, bearing cage 362, and throughbore 358 of the second primary ram guide 330 include one or more non-circular portions. More preferably, a plurality of complimentary flat surfaces are provided on the second outer ram 360 and the throughbore 358 so that needle bearings can be supported within the bearing cage 362 so that a preload can be provided for increased accuracy and guiding ability. Preferably, the same configuration for the second outer ram 360 and second primary ram guide 330 as shown if FIGS. 41, 42 and 43 are utilized.

Moreover, the first primary ram guide 326 and first outer ram 336 combination are preferably the same as the second primary ram guide 330 and second outer ram 360 combination, but they need not be. Preferred primary ram guides include roller guide assemblies that are commercially available and that can be modified for multiple actuation in accordance with the present invention. Such modification includes the provision of additional bore(s) within a primary ram to define an outer ram with throughbore(s) for additional actuations. Guide assembly suitable for modification in accordance with the present invention are commercially available from Enomoto Co., Ltd., Japan, under the trade designation "Guidemax."

At the top end of the second outer ram 360 (as viewed in FIG. 16) another forming die support plate 364 is provided. Like support plate 340, the support plate 364 may be adaptable to secure a forming die or other forming component thereto or may itself include features of use in a forming operation.

At the bottom end of the second outer ram 360, a bottom stop 366 is connected to the end of the second outer ram 360 by way of an annular spacer 368. Conventional screws 369 can be used.

A second inner ram 370 is also provided to move longitudinally between extended and retracted positions within a longitudinal throughbore 372 passing through the second outer ram 360. At least one bushing 373 is also preferably provided between the outer surface of the second inner ram 370 and the inner surface defining the longitudinal throughbore 372. Again, bushing 373 may instead comprise a bearing cage utilizing roller or needle bearings. The throughbore 372 and second inner ram 370 may be circular in cross-section, as illustrated, or may include non-circular portions in the same manner as those described above.

A forming button 374 is connected to the top end of the second inner ram 370, and may be connectable to a component of a forming operation, or may itself comprise a feature or features required of a forming operation. The forming button 374 along with the support plate 364 provide for multiple independent forming operations in the same manner as forming button 350 and support plate 340, described above.

At the bottom end of the second inner ram 370, a piston 376 is provided so as to move with the second inner ram 370. The piston 376 is shaped similar to the opening defined within the annular spacer 368 (the opening thereof being greater in at least one aspect than the throughbore 372) and is preferably sized to provide a substantially sealing sliding engagement therebetween. A reduced diameter portion 378 of the second inner ram 370 extends through the piston 376 and extends toward a depression 380 provided partially through the thickness of the bottom stop 366. Like the first inner ram 346, described above, the second inner ram 370 is thusly guided for movement within the longitudinal throughbore 372 and can be controlled by the movement of piston 376 between an extended position wherein the piston 376 abuts a bottom edge of the second outer ram 360 and a retracted position where the reduced diameter portion 378 abuts the depression 380. The range of movement is denoted by the distance Y in FIG. 16.

Piston 376 is shifted along with the second inner ram 370 between extended and retracted positions in the same manner as described above with regard to the piston 352 attached to the first inner ram 346. That is, pressurized fluid can be provided to a chamber on a first side of the piston 376 defined with the annular spacer 368 and the bottom stop 366 so as to shift piston 376 upwards (as viewed in FIG. 16) to an extended position of the second inner ram 370. To retract, pressurized fluid, again preferably air, can be supplied to a second chamber defined on the other side of piston 376 and within the annular spacer 368, the throughbore 372 and bushing 373. With the exhaust of fluid from the first defined chamber at the same time, the piston 376 will shift downwardly along with the second inner ram 370. Again, pneumatic controls are preferably utilized so that any fluid leakage between the annular spacer 368 and piston 376 will not cause problems with fluid spillage or loss. A fluid supply and exhaust system such as that shown in FIG. 40 can be similarly incorporated to move piston 376 between positions.

Figure 16:
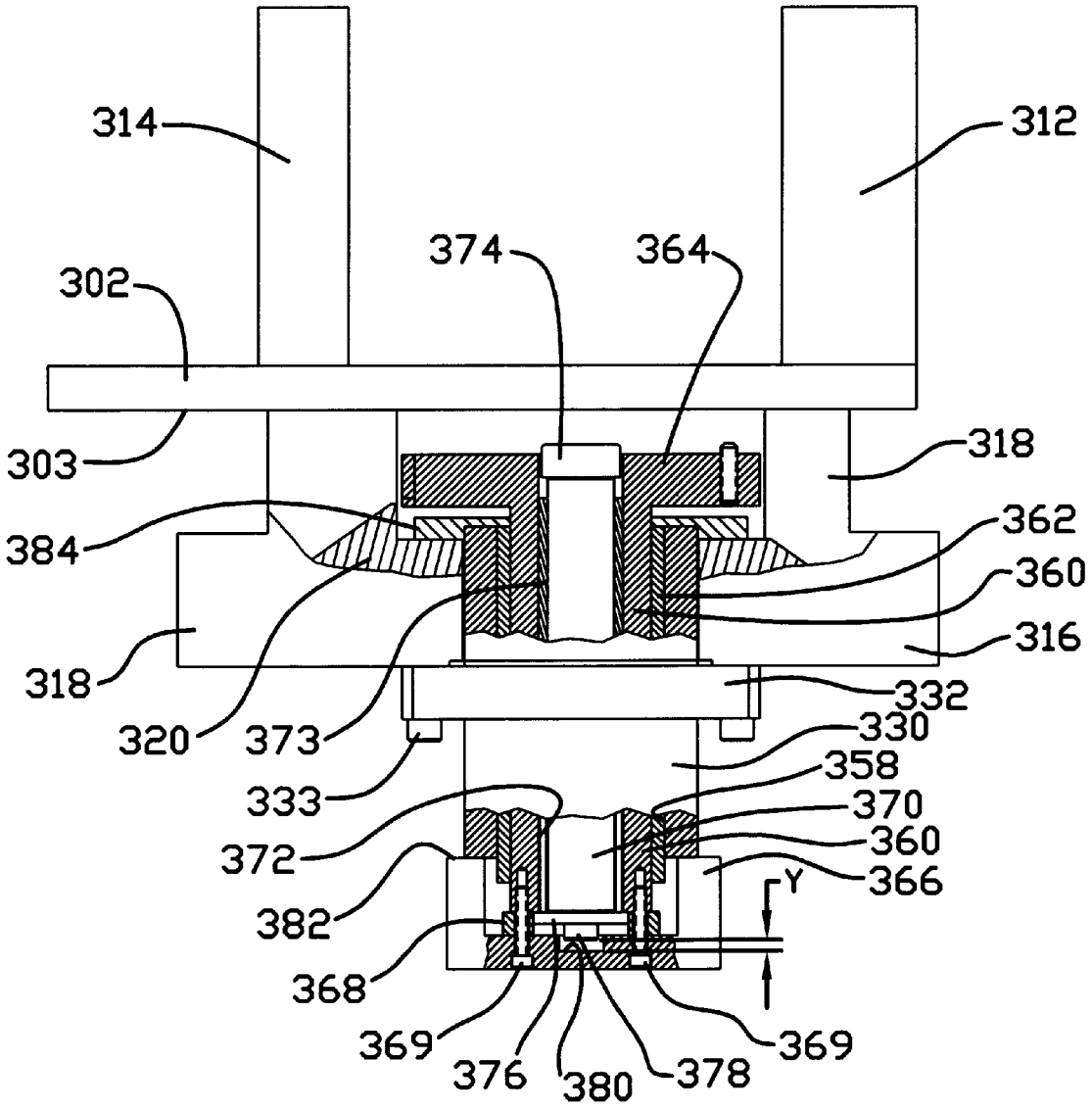
FIG. 16 is an enlarged front view of the second component side of the forming press of FIG. 9 contained within the chain line oval E of FIG. 13.

The range of movement of the second outer ram 360 is defined by the bottom stop 366 and the support plate 364. That is, in an extended position, as shown in FIG. 16, a surface 382 of the bottom stop 366 abuts against a bottom surface of the second primary ram guide 330, which itself is fixed in position by way of flange 332 and bottom guide plate 316. A retracted position is limited by a bottom surface of the support plate 364 that is opposed to a top end surface of the second primary ram guide 330. As shown in FIG. 16, the surfaces are spaced from one another by a distance which equals the range of movement of the second outer ram 360 relative to the second primary ram guide 330. A cushion 384 is preferably provided, as shown in FIG. 16, within the aforementioned space between the support plate 364 and the upper surface of the second primary ram guide 330. The cushion 384 preferably compresses so as not to be a factor in limiting the range of movement of the second outer ram 360.

Actuation of the first outer ram 336 and the second outer ram 360 can be accomplished by same or different techniques. Moreover, any conventional mechanical, pneumatic, hydraulic, electrical, electromagnetic, or otherwise technique or combinations thereof, can be utilized as actuators for the outer rams, middle rams, or inner rams, etc., if provided.

Figure 9:
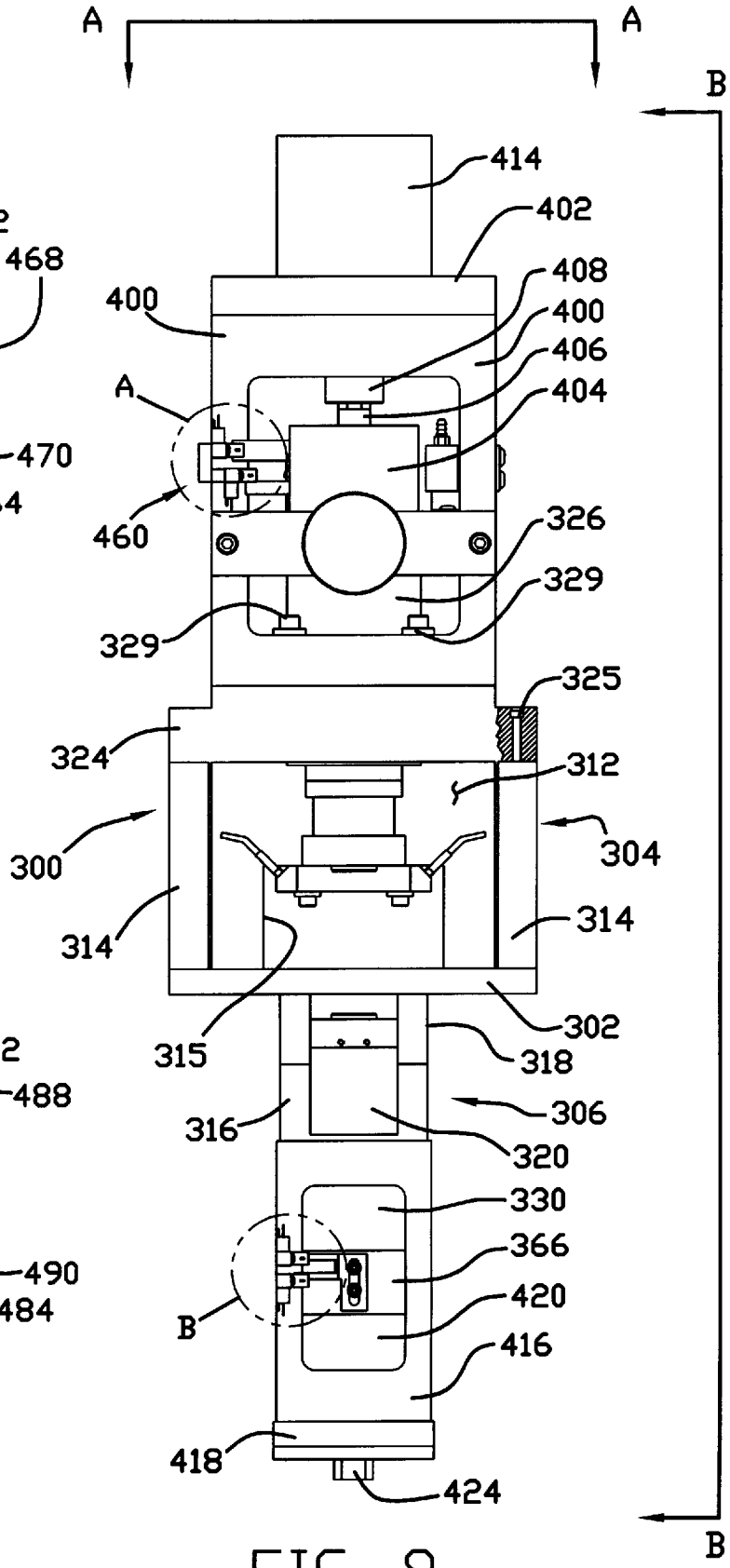
FIG. 9 is a front view of yet another forming press in accordance with the present invention, including a first component side and second component side, each including multiple actuation mechanisms for performing plural forming operations within a single forming press.
Figure 13:
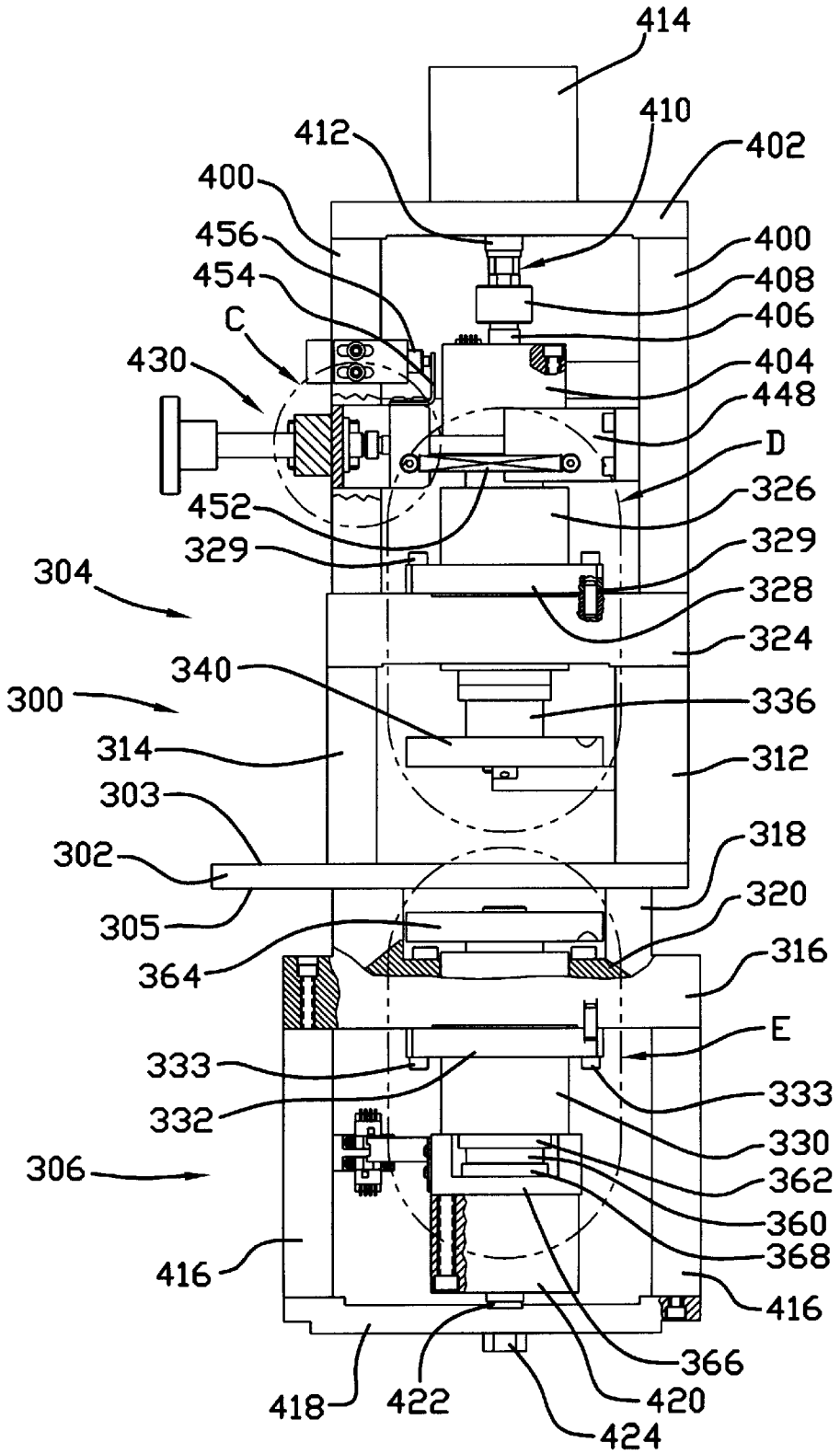
FIG. 13 is a side view taken along line B—B of the apparatus shown in FIG. 9.

As shown in FIGS. 9 and 13, further support structures are provided on both the first and second component sides 304 and 306 for the actuators of the illustrated embodiment Specifically, on the first component side 304, a pair of top standoffs 400 are provided and attached above the top guide plate 324. A top cylinder plate 402 is then connected to the top ends of the top standoffs 400. A first air cylinder 404 is supported in position relative to the top standoffs 400. The first air cylinder 404 may be fixed in any way with respect to the stationary structure on the first component side 304 or may be movably mounted relative to this structure, for example, as described below. Preferably, the first air cylinder 404 is mounted to the top stop 342 (see FIG. 15) of the first outer ram 336, such as by conventional screws. Then, the body of the first air cylinder 404 will move with the top stop 342, which is in turn fixed with the first outer ram 336 to move between its retracted and extended positions. To accomplish this movement, a piston 406 of the first air cylinder 404 extends from the body of the first air cylinder 404 so as to abut against an element 408 that is longitudinally maintained in position. Then, by extending the piston 406 from the first air cylinder 404, the body of the first air cylinder 404 is caused to shift (downwardly as shown in FIG. 13) so as to thus move the top stop 342 and the first outer ram 336 to an extended position. Then, by causing the piston 406 to be retracted within the first air cylinder 404, the top stop 342 and thus the first outer ram 336 are caused to retract. To accomplish this, the end of piston 406 can be connected with the element 408 which itself is maintained at a predetermined longitudinal position.

As an added feature of the forming machine 300 shown in FIG. 13, the element 408 is also connected via a coupler 410 to a piston 412 of a second air cylinder 414. Thus, the element 408 can be longitudinally held at any one of a plurality of longitudinal positions under the control of the second air cylinder 414. Like piston 406, piston 412 is connected by the coupler 410 to move with the element 408. Then, the element 408 is not only selectively positionable longitudinally by the second air cylinder 414, so is the entire first air cylinder 404, top stop 342, and first outer ram 336. The connection provided by the coupler 410 is preferably a "loose" connection in the sense that it provides flexibility to allow for misalignment of the pistons 406 and 412. That is, the coupler 410 provides a definite and tight fit in the longitudinal direction of the pistons 406 and 412, but permits a range of movement in the perpendicular direction so that the piston 406 (via element 408) and piston need not be precisely aligned. Thus, accurate alignment of the first primary ram guide 326, and in turn all its auxiliary and internal components, is substantially unaffected by the presence of the second air cylinder 414. In accordance with this preferred design, precise mounting of the first primary ram guide 326 results in alignment of everything else on the first component side 304 for the reasons discussed above.

Preferably, the stroke of second air cylinder 414 is much longer than the operating stroke of the first air cylinder 404. Then, by the operative longitudinal fixing of the piston 412 all the way to the support plate 340, retraction of piston 412 (with piston 406 also retracted) will move support plate 340 to a wide open position which is desirable to facilitate die removal and installation and/or to permit machine servicing. This wide open position is limited by the engagement of the top surface of support plate 340 with the bottom surface of the first primary ram guide 326.

Figure 12:
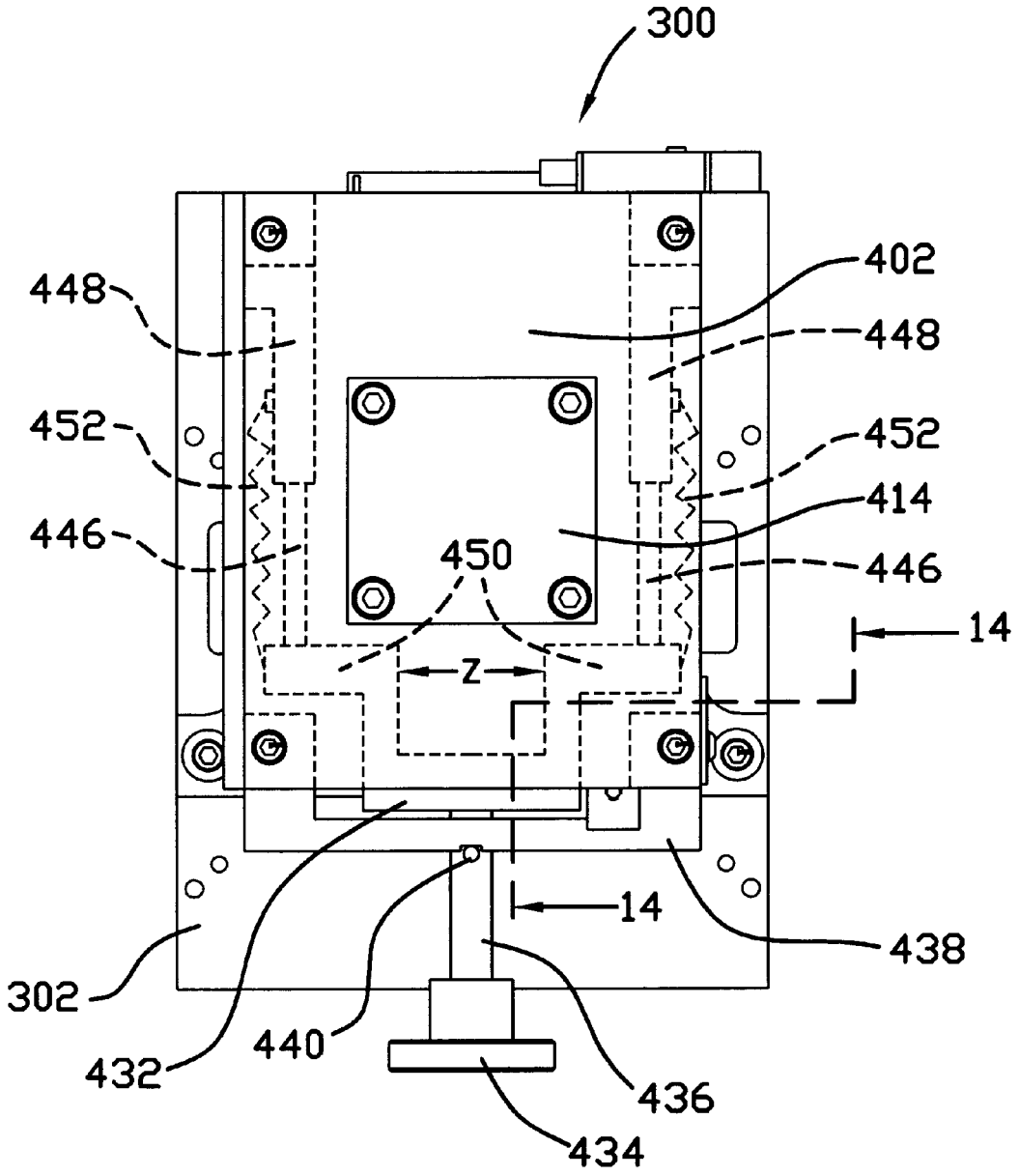
FIG. 12 is a top view taken along line A—A of the apparatus shown 3in FIG. 9.
Figure 14:
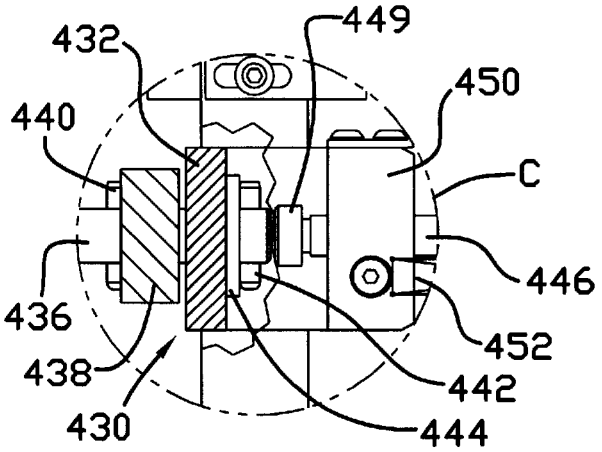
FIG. 14 is an enlarged detail of a safety mechanism contained within the chain line circle C of FIG. 13.

A safety lock mechanism is also preferably provided as shown at 430 in FIGS. 12, 13 and 14 for preventing the second air cylinder 414 from unintentionally moving the first outer ram 336 and its support plate 340 from fully retracted positions to their operative positions. Specifically, a yoke 432 is provided to be positionable in a blocking position between a top surface of the first primary ram guide 326 and the bottom of the first air cylinder 404 (actually the bottom surface of top stop 342, on top of which the air cylinder 404 is mounted) when the second air cylinder 414 is fully retracted. Preferably, also the second air cylinder 414 is actuable by a knob 434 that also causes the safety lock mechanism 430 to be activated by moving the yoke 432 into the blocking position.

The knob 434 is fixed to a shaft 436 that is slidable through a crossbeam guide 438 that is mounted to across the front top standoff 400 (the front one as viewed in FIG. 9). The shaft 436 has a first pin 440 at an intermediate location, and the crossbeam guide 438 has a corresponding opening (not shown), so that the shaft 436 can move longitudinally through crossbeam guide 438 when pin 440 and the opening of crossbeam guide 438 are radially aligned. Furthermore, when the pin 440 and opening of crossbeam guide 438 are not radially aligned, the knob 434 and its shaft 436 can be maintained at an outward position (to the left as viewed in FIGS. 13 and 14) by the engagement of pin 440 with the crossbeam guide 438. The yoke 432 is also connected to the inner end of shaft 436 by a second cross pin 442 and washer 444 so that shaft 436 is freely rotatable but the yoke 432 is retractable.

As shown in phantom in FIG. 12, yoke 432 is guided to move between blocking and unlocking positions by a pair of guide rods 446 that are spaced to straddle the assembly of the first primary ram guide 336 and air cylinder 404. Each guide rod 446 is supported by a bracket 448 connected to the rear top standoff 400 (to the right in FIG. 13) and terminates at a head 449. Side portions 450 of the yoke 432 each include a guide opening (not shown) for sliding over the guide rods 446 as the yoke is moved between ex-tended and retracted positions. Extension springs 452 also extend between the yoke 432 and the brackets 448 so as to urge the yoke toward its blocking position (to the right in FIG. 13).

A bracket 454 is also preferably attached to the yoke 432 and is positioned so as to hit a valve switch 456 mounted to the front top standoff 400 when the knob 434 and shaft 436 are fully retracted. In this position, the valve switch 456 is preferably operatively configured so that the second air cylinder 414 is maintained in its extended position, and the first outer ram 336 is operatively positioned. To retract the first outer ram 336 from its operative position and to activate the safety mechanism 430, the knob 434 is turned until its first pin 440 is aligned with the opening through the crossbeam guide 438. Then, under the bias of springs 452, yoke 432, shaft 436 and knob 434 will move initially a short distance until the bracket 454 releases the valve switch 456. This actuates the second air cylinder 414 to retract which raises the first outer ram 336 to a safety position. In sequence, as soon as the top stop 342 of the first outer ram 336 clears the area, the yoke 432 assumes its blocking position by force of the spring bias of springs 452. The yoke 432 defines an area between its end portion 450 having a width Z sized larger than the diameter of the first outer ram 336, but small enough so that the top stop 342 is blocked. Even if it is attempted to extend the second air cylinder 414 at this time, the upper surface of the yoke 432 will block its movement. To put the first outer ram 336 back into its operative position, the knob 434 and its shaft 436 are retracted against the bias of springs 452, which also pulls the yoke 432 out of its blocking position. When the bracket 454 eventually hits the valve switch 456, the second air cylinder 414 is actuated to extend the first outer ram 336 to its operative position. The yoke 432 is again locked in place by turning the shaft 436 to radially misalign its pin 440 from the opening of the crossbeam guide 438.

Figure 10:
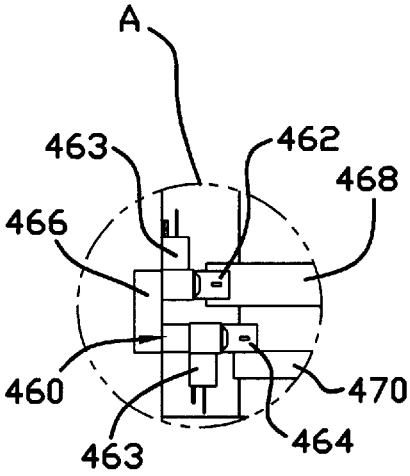
FIG. 10 is an enlarged detail of a sensor system for the first component side taken from the chain line circle A of FIG. 9.
Figure 11:
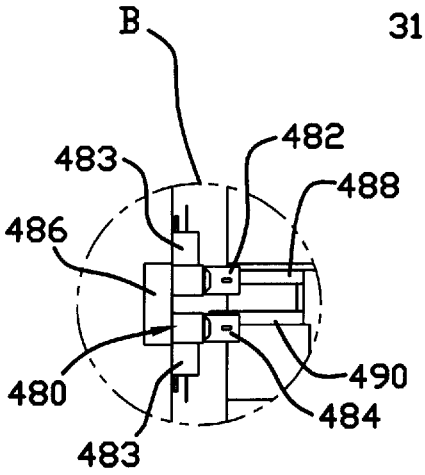
FIG. 11 is an enlarged detail of a sensor system for the second component side taken from the chain line circle B of FIG. 9.

A sensor system 460 is also preferably provided as shown in FIGS. 9 and 10 so that the positions of the first outer ram 336 can be tracked. A horseshoe photo sensor comprising two optical cells 462 and 464 is preferably mounted via a bracket 466 to the front top standoff 400. Each optical cell 462 and 464 includes an electrical connector 463 for connection with a monitoring and/or control system that can be provided in any way, if desired. The optical cells 462 and 464 are spaced from one another by a predetermined distance so that the position of the first outer ram 336 can be monitored by the provision of a pair of spaced flags 468 and 470 that are operatively connected to move with the first outer ram 336. They are provided in accordance with a predetermined spacing and can be connected, for example, to the cylinder 404, top stop 342 or the first outer ram 336. The use of two optical cells 462 and 464 and two flags 468 and 470 permit four positions to be determined. As shown in FIGS. 9 and 10, when the top optical cell 462 is blocked by flag 468 while the bottom optical sensor 464 is unblocked by flag 470, a lower position of the first outer ram 336 is read. As the first outer ram 336 is moved upward, the flag 470 will block optical sensor 464 while optical sensor 462 is still blocked by flag 468. This indicates an intermediate position. Upon further upward movement to a normal up position of the first outer ram 336, the top optical sensor 462 is unblocked by flag 468 while flag 470 still blocks the bottom optical sensor 464. Further movement upward to the safety position of the first outer ram 336 is detected when both optical sensors 462 and 464 are unblocked by flags 468 and 470. With each of the four states having a different read pattern, the position of the first out ram 336 can be determined at any given time.

On the second component side 308, a similar arrangement is provided although different arrangements are certainly possible. As shown in FIGS. 9 and 13, bottom standoffs are connected to and fixed in position with the bottom guide plate 316. A bottom cylinder plate 418 connects the bottom ends of the bottom standoffs 416. In a similar manner as above, a third air cylinder 420 is preferably connected with the bottom stop 366, such as by conventional screws, so as to move with the bottom stop 366, and thus the second outer ram 360. A piston 422 of the third air cylinder 420 extends from a body of the third air cylinder 420 and is connected to the bottom cylinder plate 418 by a cylinder bolt 424.

To extend the second outer ram 360, the third air cylinder 420 is fired so that its piston 422 is extended, thereby raising the third air cylinder 420 (as viewed in FIG. 13) along with the bottom stop 366 and the second outer ram 360. To retract the second outer ram 360, the piston 422 is retracted within the third air cylinder 420. The piston 422 need only be limited in its axial direction thereof so as to cause this retraction (upward as viewed in FIG. 13). It may be unrestricted in the opposite longitudinal direction.

Like the sensor system 460 described above, the second component side 308 also preferably includes a sensor system 480 comprising a horseshoe photo sensor comprising two optical cells 482 and 484 that are preferably mounted via a bracket 486 to the front bottom standoff 416. Each optical cell 482 and 484 includes an electrical connector 483 for connection with a monitoring and/or control system that can be provided in any way, if desired. The optical cells 482 and 484 are spaced from one another by a predetermined distance so that the position of the second outer ram 360 can be monitored by the provision of a pair of spaced flags 488 and 490 that are operatively connected to move with the second outer ram 360. They are provided in accordance with a predetermined spacing and can be connected, for example, to the bottom stop 366 or the second outer ram 360. The use of two optical cells 482 and 484 and two flags 488 and 490 permit four positions to be determined, although only three are needed for this side. Any three of the four states described above with respect to sensor system 460 can be utilized to indicate upper, intermediate and lower operative positions of the second outer ram 360. Thus, the position of the second outer ram 360 can also be determined at any given time.

As with the above described embodiments, this embodiment can provide multiple actuations from both sides of the support plate 302. Moreover, each actuation is independent from the others so that any sequence of actuations can be controlled. The machine 300 is preferably controlled by a pneumatic circuit, the specifics of which will depend largely on the sequence of operations to be performed and the number of operations to be performed. Conventional pneumatic circuit technology can be utilized based upon any specific application.

Moreover, more actuations can be provided for in accordance with the present invention. That is, the primary ram guides 326 and 330 may include more than one longitudinal bore, each of which having the capability to provide yet another actuation. For each independent actuation, a different forming operation can be performed. Forming operations include, without limitation, clamping operations (where actuations from both sides cause a part to be clamped therebetween), bending from one or both sides, stamping (such as with complimentary punch and die), or detabbing (where a part is disconnected and ejected from a carrier strip if it is rejected).

Furthermore, like the machines described above, any conventional mechanism for providing a single part or a carrier strip of parts through the forming machine 300 can be combined therewith. Such structure can easily be accommodated by the main support plate 302.

It is claimed:

1. A multiple actuation forming press having a first component side and a second component side, said forming press comprising a support structure, a first primary ram guide connected to said support structure on a first component side thereof, a second primary ram guide connected to said support structure at a predetermined alignment thereof with respect to said first primary ram guide and on a second component side of said support structure so as to defame a forming area between said first and second primary ram guides, a first outer ram slidably guided by an opening defined at least in part by said first primary ram guide, a second outer ram slidably guided by an opening defined at least in part by said second primary ram guide, a first actuator for moving said first outer ram between extended and retracted positions toward and away from the forming area, and a second actuator for moving said second outer ram between extended and retracted positions toward and away from the forming area, wherein said first outer ram is provided with an inner guiding surface that extends in the same direction of slidable movement of said first outer ram, and which slidably guides a first inner ram that is connected with a first inner ram actuator for moving said first inner ram between extended and retracted positions independently from the slidable movement of said first outer ram toward and away from the forming area based upon the alignment of the first and second primary ram guides, such that a press forming operation can be performed between said first outer ram and said second outer ram within the forming area by movement of said first and second outer rams toward the forming area.

2. The forming press of claim 1, wherein the second outer ram is also provided with an inner guiding surface that extends in the same direction of slidable movement of said second outer ram, and which slidably guides a second inner ram that is connected with a second inner ram actuator for moving said second inner ram between extended and retracted positions toward and away from the forming area based upon the alignment of the first and second primary ram guides.

3. The forming press of claim 2, wherein said first outer ram is further provided with a plurality of inner guiding surfaces that extend in the same direction of slidable movement of said first outer ram, and which slidably guide a third inner ram that is connected with a third inner ram actuator for moving said third inner ram between extended and retracted positions toward and away from the forming area based upon the alignment of the first and second primary ram guides.

4. The forming press of claim 2, wherein said first inner ram is provided with an inner guiding surface that extends in the same direction of slidable movement of said first outer ram and said first inner ram, and which slidably guides a first more inner ram that is connected with a first more inner ram actuator for moving said first more inner ram between extended and retracted positions toward and away from the forming area based upon the alignment of the first and second primary ram guides.

5. The forming press of claim 4, wherein said guiding surfaces of said first and second outer rams and of said first inner ram comprise throughbores.

6. The forming press of claim 5, further including forming components connected to ends of said first and second outer rams, said first and second inner rams, and said first more inner ram.

7. The forming press of claim 1, wherein said first and second primary ram guides include openings defined therethrough for slidably guiding said first and second outer rams, respectively, and wherein said openings each include at least a non-circular portion as viewed in transverse cross-section.

8. The forming press of claim 7, wherein said openings each include plural non-circular portions as viewed in transverse cross-section.

9. The forming press of claim 8, wherein said non-circular portions are flat portions, and further including needle bearings supported between said flat portions and corresponding flat portions provided on outer surfaces of said first and second outer rams.

10. The forming press of claim 1, wherein said first and second primary ram guides are comprised of plural components that together define openings therethrough for slidably guiding said first and second outer rams, respectively, and wherein said openings each include at least a non-circular portion as viewed in transverse cross-section.

11. The forming press of claim 10, wherein said first and second primary ram guides each comprise a pair of spaced components that each define a non-circular portion of said opening that are releasably connected to one another and spaced from one another by at least one spacer plate.

12. A method of forming a part by a forming press comprising:

providing a forming press having a first component side and a second component side, the first component side having a first primary ram guide and the second component side having a second primary ram guide, the first and second primary ram guides being aligned with one another at predetermined positions to define a forming area therebetween;

providing a part to be formed in the forming area of the forming press;

actuating first and second outer rams while slidably guiding the first and second outer rams by the first and second primary ram guides, respectively, so as to advance the first and second outer rams independently toward the forming area, such that a press forming operation can be performed within said forming area between said first outer ram and said second outer ram;

actuating a first inner ram while slidably guiding the first inner ram by an inner guiding surface of the first outer ram, so as to advance the first inner ram independently toward the forming area; and providing a forming component on at least one of the first and second outer rams and the first inner ram so that the part is formed during one of the advancing operations.

13. The method of claim 12 comprising a method of forming a head suspension blank provided as attached to a carrier strip.

14. A multiple actuation forming press having a first component side and a second component side, said forming press comprising a support structure, a first primary ram guide connected to said support structure on a first component side thereof, a second primary ram guide connected to said support structure at a predetermined alignment thereof with respect to said first primary ram guide and on a second component side of said support structure, said first and second primary ram guides being aligned with one another at predetermined positions to define a forming area therebetween, a first outer ram slidably guided by an opening defined at least in part by said first primary ram guide, a second outer ram slidably guided by an opening defined at least in part by said second primary ram guide, a first actuator for moving said first outer ram between extended and retracted positions toward and away from the forming area, and a second actuator for moving said second outer ram between extended and retracted positions toward and away from the forming area, wherein said first outer ram is provided with an inner guiding surface that extends in the same direction of slidable movement of said first outer ram, and which slidably guides a first inner ram that is connected with a first inner ram actuator for moving said first inner ram between extended and retracted positions independently from the slidable movement of said first outer ram toward and away from the forming area based upon the alignment of the first and second primary ram guides, and wherein said second outer ram is also provided with an inner guiding surface that extends in the same direction of slidable movement of said second outer ram, and which slidably guides a second inner ram that is connected with a second inner ram actuator for moving said second inner ram between extended and retracted positions independently from the slidable movement of said second outer ram toward and away from the forming area based upon the alignment of the first and second primary ram guides, such that a press forming operation can be performed within the forming area by movement of said first and second outer rams toward the forming area.

15. The forming press of claim 14, wherein said first outer ram is further provided with a plurality of inner guiding surfaces that extend in the same direction of slidable movement of said first outer ram, and which slidably guide a third inner ram that is connected with a third inner ram actuator for moving said third inner ram between extended and retracted positions toward and away from the forming area based upon the alignment of the first and second primary ram guides.

16. The forming press of claim 14, wherein said first inner ram is provided with an inner guiding surface that extends in the same direction of slidable movement of said first outer ram and said first inner ram, and which slidably guides a first more inner ram that is connected with a first more inner ram actuator for moving said first more inner ram between extended and retracted positions toward and away from the forming area based upon the alignment of the first and second primary ram guides.

17. The forming press of claim 16, wherein said guiding surfaces of said first and second outer rams and of said first inner ram comprise throughbores.

18. The forming press of claim 17, further including forming components connected to ends of said first and second outer rams, said first and second inner rams, and said first more inner ram.

19. A multiple actuation forming press having a first component side and a second component side, said forming press comprising a support structure, a first primary ram guide connected to said support structure on a first component side thereof, a second primary ram guide connected to said support structure at a predetermined alignment thereof with respect to said first primary ram guide and on a second component side of said support structure so as to define a forming area between said first and second primary ram guides, a first outer ram slidably guided by an opening defined at least in part by said first primary ram guide, a second outer ram slidably guided by an opening defined at least in part by said second primary ram guide, a first actuator for moving said first outer ram between extended and retracted positions toward and away from the forming area, and a second actuator for moving said second outer ram between extended and retracted positions toward and away from the forming area, wherein said first outer ram is provided with an inner guiding surface that extends in the same direction of slidable movement of said first outer ram, and which slidably guides a first inner ram that is connected with a first inner ram actuator for moving said first inner ram between extended and retracted positions independently from the slidable movement of said first outer ram toward and away from the forming area based upon the alignment of the first and second primary ram guides, and wherein said first and second primary ram guides are comprised of plural components that together define openings therethrough for slidably guiding said first and second outer rams, respectively, and wherein said openings each include at least a non-circular portion as viewed in transverse cross-section.

20. A method of forming a part by a forming press comprising:

providing a forming press having a first component side and a second component side, the first component side having a first primary ram guide and the second component side having a second primary ram guide, the first and second primary ram guides being aligned with one another at predetermined positions to define a forming area therebetween;

providing a part to be formed in the forming area of the forming press;

actuating first and second outer rams while slidably guiding the first and second outer rams by the first and second primary ram guides, respectively, so as to advance the first and second outer rams independently toward the forming area;

actuating a first inner ram while slidably guiding the first inner ram by an inner guiding surface of the first outer ram, so as to advance the first inner ram independently toward the forming area;

actuating a second inner ram while slidably guiding the second inner ram by an inner guiding surface of the second outer ram, so as to advance the second inner ram independently toward the forming area; and providing a forming component on at least one of the first and second outer rams and the first and second inner rams so that the part is formed during one of the advancing operations.

* * * * *